US009464506B2

(12) United States Patent
Coon et al.

(10) Patent No.: US 9,464,506 B2
(45) Date of Patent: Oct. 11, 2016

(54) SLIDING SLEEVE VALVE AND METHOD FOR FLUID TREATING A SUBTERRANEAN FORMATION

(75) Inventors: Robert Joe Coon, Missouri City, TX (US); Daniel Jon Themig, Calgary (CA); John Lee Emerson, Katy, TX (US); Gustavo Mendoza, Houston, TX (US)

(73) Assignee: PACKERS PLUS ENERGY SERVICES INC., Calgary (CA)

( * ) Notice: Subject to any disclaimer, the term of this patent is extended or adjusted under 35 U.S.C. 154(b) by 288 days.

(21) Appl. No.: 14/113,788

(22) PCT Filed: May 2, 2012

(86) PCT No.: PCT/CA2012/000412

§ 371 (c)(1), (2), (4) Date: Oct. 24, 2013

(87) PCT Pub. No.: WO2012/149638

PCT Pub. Date: Nov. 8, 2012

(65) Prior Publication Data

US 2014/0048271 A1 Feb. 20, 2014

Related U.S. Application Data

(60) Provisional application No. 61/481,987, filed on May 3, 2011, provisional application No. 61/509,748, filed on Jul. 20, 2011.

(51) Int. Cl.

*E21B 34/06* (2006.01)
*E21B 34/10* (2006.01)

(Continued)

(52) U.S. Cl.

CPC ..... *E21B 34/06* (2013.01); *E21B 34/063* (2013.01); *E21B 34/102* (2013.01);

(Continued)

(58) Field of Classification Search

CPC ..... E21B 34/06; E21B 43/16; E21B 43/26; E21B 34/063; E21B 34/103; E21B 34/102; E21B 34/14; E21B 2034/007

See application file for complete search history.

(56) References Cited

U.S. PATENT DOCUMENTS 4,928,772 A 5/1990 Hopmann
6,907,936 B2 6/2005 Fehr et al.

(Continued)

FOREIGN PATENT DOCUMENTS

WO WO 2009/029437 A1 3/2009

*Primary Examiner* — Brad Harcourt

(74) *Attorney, Agent, or Firm* — Bennett Jones LLP

(57) ABSTRACT

A sliding sleeve valve for wellbore operations includes: a tubular body including a tubular wall including an outer surface and an inner surface defining an inner bore; a fluid port extending through the tubular wall and providing fluidic communication between the outer surface and the inner bore; a sliding sleeve in the inner bore slidably moveable between a port closed position and a port open position, the sliding sleeve including a ball seat on which a plug is landed to move the sleeve from the port closed position to the port open position; an initial sleeve holding mechanism for holding the sliding sleeve in the port closed position, the initial sleeve holding mechanism selected to be overcome by landing a plug on the ball seat to move the sliding sleeve; and a second sleeve holding mechanism for holding the sliding sleeve in the port closed position after the sliding sleeve is reclosed from the port open position to the port closed position, the second sleeve holding mechanism selected to be overcome by landing a plug on the ball seat to move the sliding sleeve.

46 Claims, 12 Drawing Sheets

Figure 1A:
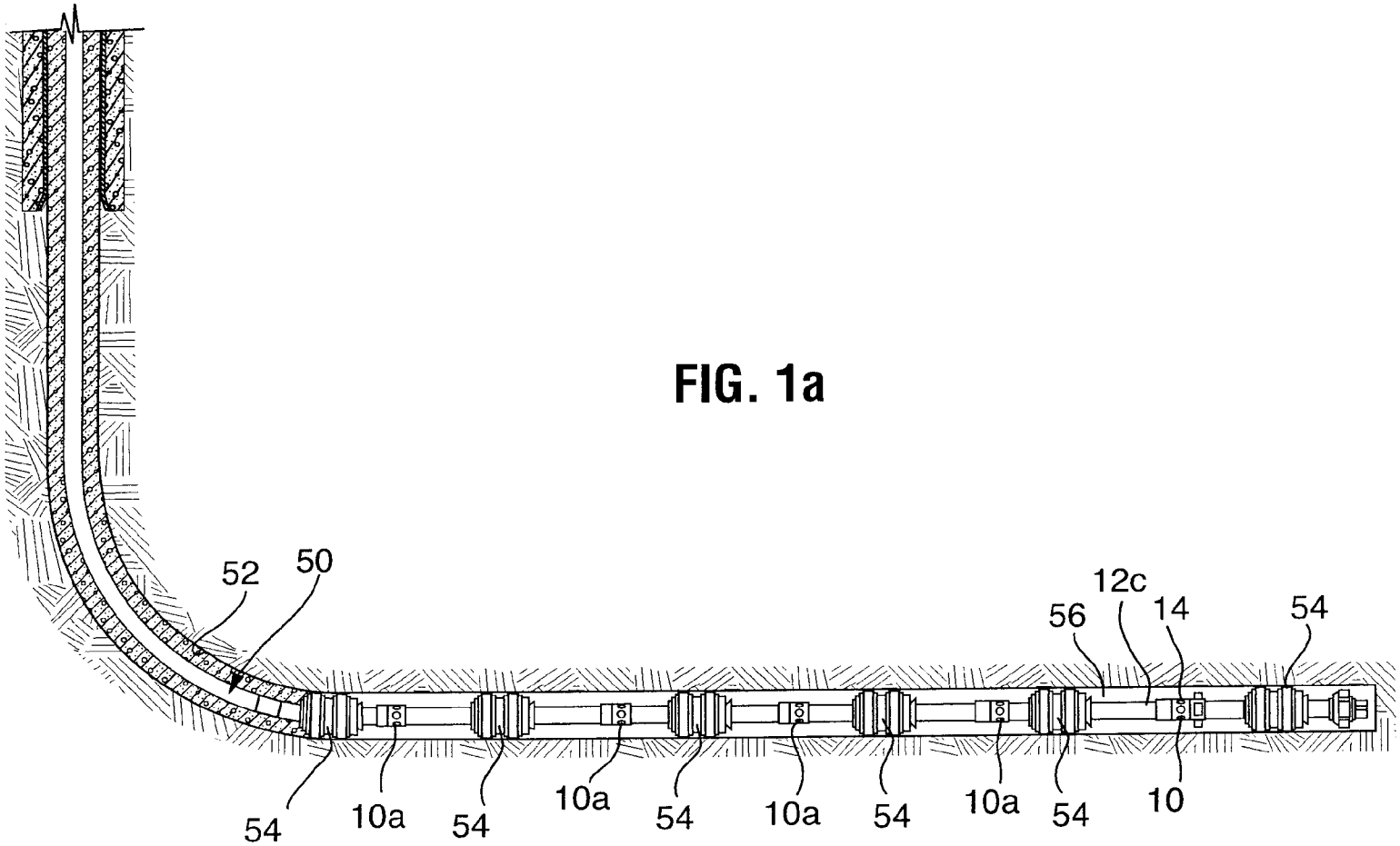

(51) Int. Cl.

| | |
|---|---|
| ***E21B 34/14*** | (2006.01) |
| ***E21B 43/16*** | (2006.01) |
| ***E21B 43/26*** | (2006.01) |
| *E21B 34/00* | (2006.01) |

(52) U.S. Cl.
CPC ..... *E21B 34/103* (2013.01); *E21B 34/14* (2013.01); *E21B 43/16* (2013.01); *E21B 43/26* (2013.01); *E21B 2034/007* (2013.01)

(56) References Cited

U.S. PATENT DOCUMENTS

| | | | | |
|---|---|---|---|---|
| 7,108,067 | B2 | 9/2006 | Themig et al. | |
| 7,134,505 | B2 | 11/2006 | Fehr et al. | |
| 7,350,582 | B2 * | 4/2008 | McKeachnie | E21B 33/1294 166/194 |
| 7,431,091 | B2 | 10/2008 | Themig et al. | |
| 7,543,634 | B2 | 6/2009 | Fehr et al. | |
| 7,703,510 | B2 | 4/2010 | Xu | |
| 7,748,460 | B2 | 7/2010 | Themig et al. | |
| 7,762,333 | B2 | 7/2010 | Themig et al. | |
| 7,861,774 | B2 | 1/2011 | Fehr et al. | |
| 8,167,047 | B2 | 5/2012 | Themig et al. | |
| 2003/0127227 | A1 | 7/2003 | Fehr et al. | |
| 2003/0141075 | A1 * | 7/2003 | Bixenman | E21B 47/09 166/380 |
| 2006/0124310 | A1 | 6/2006 | Lopez de Cardenas et al. | |
| 2008/0156496 | A1 * | 7/2008 | East | E21B 33/1208 166/313 |
| 2009/0056934 | A1 * | 3/2009 | Xu | E21B 43/26 166/244.1 |
| 2010/0108323 | A1 | 5/2010 | Wilkin | |
| 2011/0079381 | A1 | 4/2011 | Cejero et al. | |
| 2011/0120726 | A1 | 5/2011 | Murray et al. | |
| 2011/0232915 | A1 | 9/2011 | Kellner et al. | |
| 2011/0278010 | A1 | 11/2011 | Fehr et al. | |
| 2013/0068484 | A1 | 3/2013 | Themig et al. | |
| 2013/0180718 | A1 | 7/2013 | Fehr et al. | |

* cited by examiner

SLIDING SLEEVE VALVE AND METHOD FOR FLUID TREATING A SUBTERRANEAN FORMATION

PRIORITY APPLICATION

This application claims priority to U.S. provisional application Ser. No. 61/481,987, filed May 3, 2011 and U.S. provisional application Ser. No. 61/509,748, filed Jul. 20, 2011.

FIELD

The invention is directed to a sliding sleeve valve and a method for fluid treating a subterranean formation and, in particular, a sliding sleeve for a wellbore installation and a method for treating a subterranean formation through the sliding sleeve valve.

BACKGROUND

Fluid treatment, often called stimulation which includes fracturing, of a formation typically increases the production from that formation by a large factor. The increase in some formations only lasts about 10-18 months. In these wells it is beneficial to restimulate the formation to increase the existing fractures or to make more fractures, both of which contact more hydrocarbons. After a restimulation, the well production is typically increased, sometimes to a level close to that after the original stimulation because of the increased contact with new hydrocarbons. There is a need to provide a tool that will make re-stimulation on a previously treated stage easy and affordable. While some have suggested re-stimulation by running in with a string to close and to reopen ports, this is time consuming.

SUMMARY

In accordance with a broad aspect of the present invention, there is provided a tool and method for use in the refracturing of a formation.

In accordance with one aspect of the present invention, there is provided a sliding sleeve valve comprising: a tubular body including a tubular wall with an outer surface and an inner surface defining an inner bore; a fluid port extending through the tubular wall and providing fluidic communication between the outer surface and the inner bore; a sliding sleeve in the inner bore slidably moveable between a port closed position and a port open position, the sliding sleeve including a ball seat on which a plug is landed to move the sleeve from the port closed position to the port open position; an initial sleeve holding mechanism for holding the sliding sleeve in the port closed position, the initial sleeve holding mechanism selected to be overcome by landing a plug on the ball seat to move the sliding sleeve; and a second sleeve holding mechanism for holding the sliding sleeve in the port closed position after the sliding sleeve is reclosed from the port open position to the port closed position, the second sleeve holding mechanism selected to be overcome by landing a plug on the ball seat to move the sliding sleeve.

In accordance with another aspect of the present invention, there is provided a method for refracturing a formation, the formation having been originally fractured by landing a ball on a sleeve to move the sleeve to expose a port to fracturing fluid flow therethrough and injecting fracturing fluid through the port, the method comprising: closing the sleeve over the port; setting a holding mechanism to hold the sleeve in place; landing a ball on the sleeve to overcome the holding mechanism and to move the sleeve to expose the port to fracturing fluid flow therethrough; and injecting fracturing fluid through the port to refracture the formation.

In accordance with another aspect of the present invention, there is provided a method for fluid treatment of a formation accessed through a wellbore, the method comprising: running into the wellbore with a fluid treatment string including a sliding sleeve valve with a sleeve closing a port; landing a ball on the sleeve to overcome an initial holding mechanism for the sleeve and to move the sleeve to expose the port to a fluid flow therethrough; injecting fluid through the port to fluid treat the formation; closing the sleeve over the port; setting a second holding mechanism to hold the sleeve in place; landing a second ball on the sleeve to overcome the second holding mechanism and to move the sleeve to expose the port to a fluid flow therethrough; and injecting fluid through the port to fluid treat the formation.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

DRAWINGS

Figure 1B:
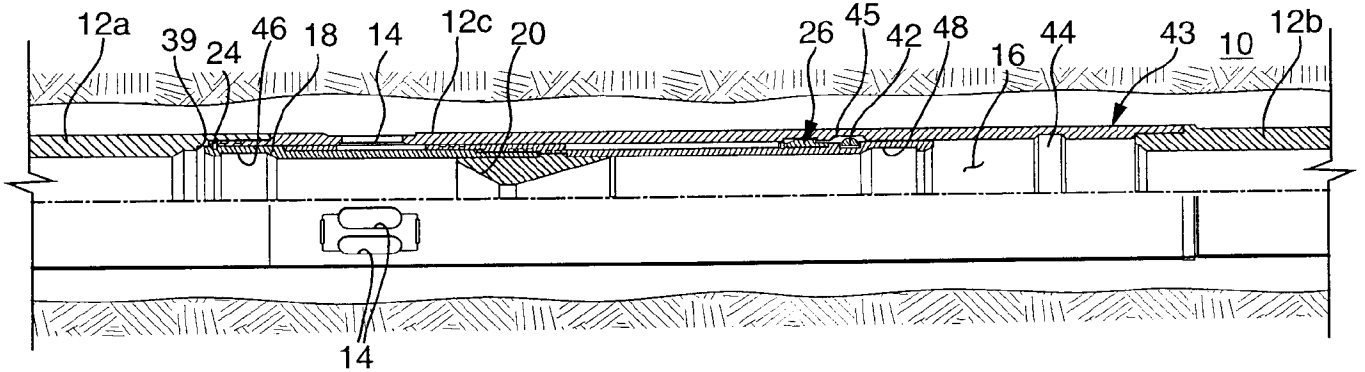
Figure 2A:
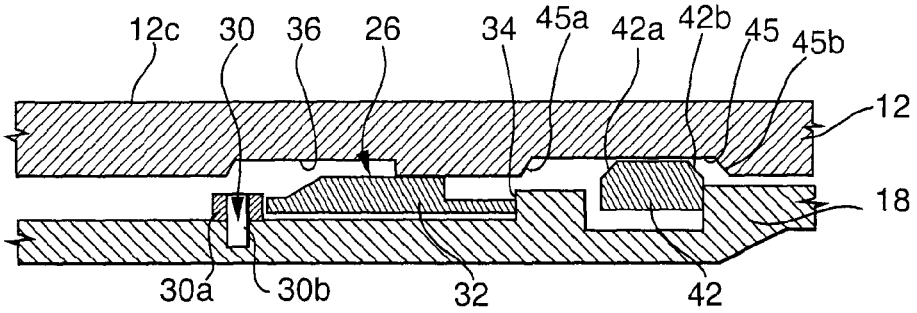
Figure 2B:
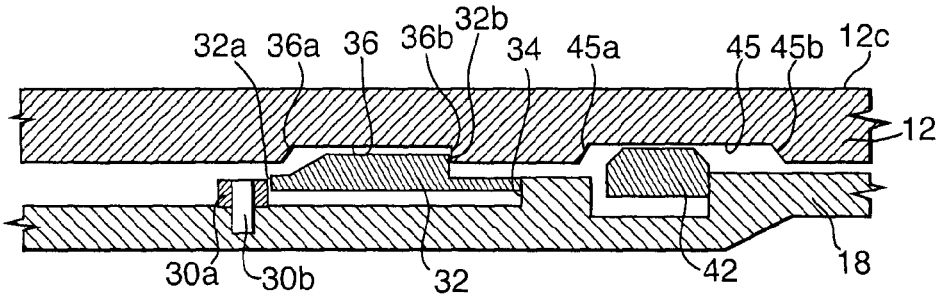
Figure 2C:
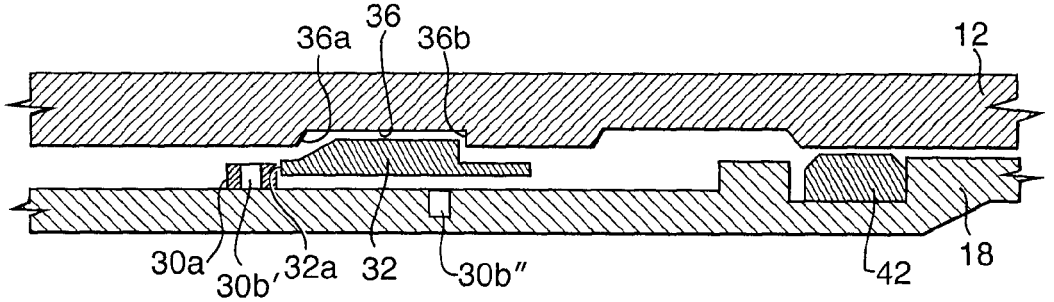

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 1*a* is a sectional view through a wellbore with a completion string including a sliding sleeve valve installed therein;

FIGS. 1*b* to 1*j* are sequential sectional views through the sliding sleeve valve of FIG. 1*a* being manipulated through a fracturing treatment and a refracturing treatment;

FIGS. 2*a* to 2*c* are sequential sectional views of an enlarged view of the second holding mechanism of FIG. 1*b;*

Figure 5A:
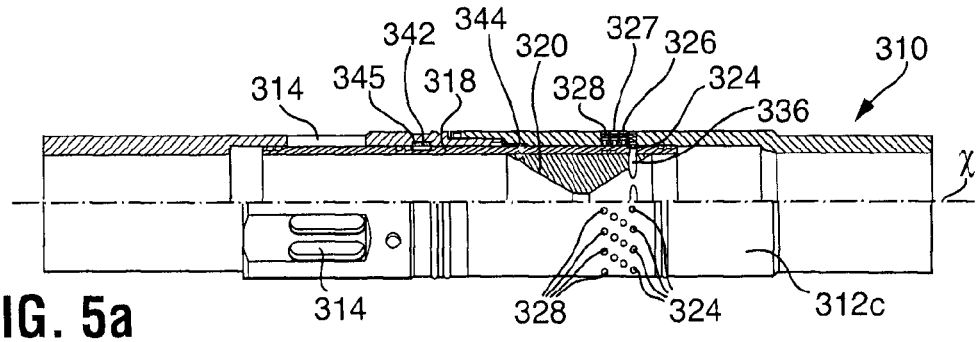
Figure 6:
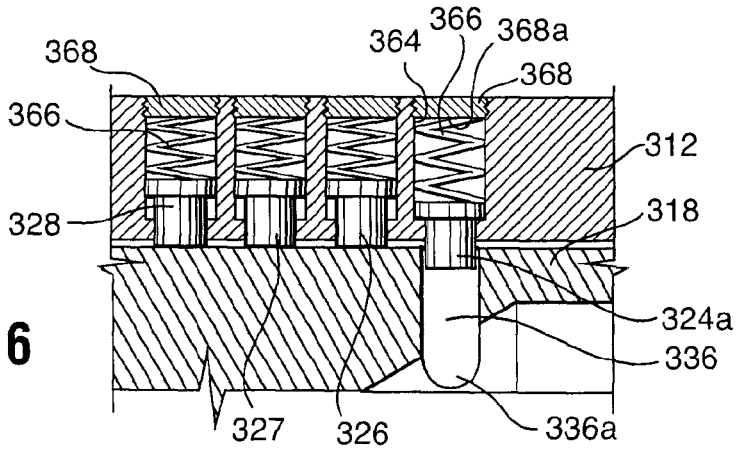

FIGS. 3*a* to 3*e* are sequential sectional views through another sliding sleeve valve useful for refracturing;

FIGS. 4*a* to 4*d* are sequential sectional views through another refracturing tool;

FIGS. 5*a* to 5*d* are sequential sectional views through another refracturing tool;

FIG. 6 is an enlarged sectional view through the shear pin array of FIG. 5*a.*

Figure 7A:
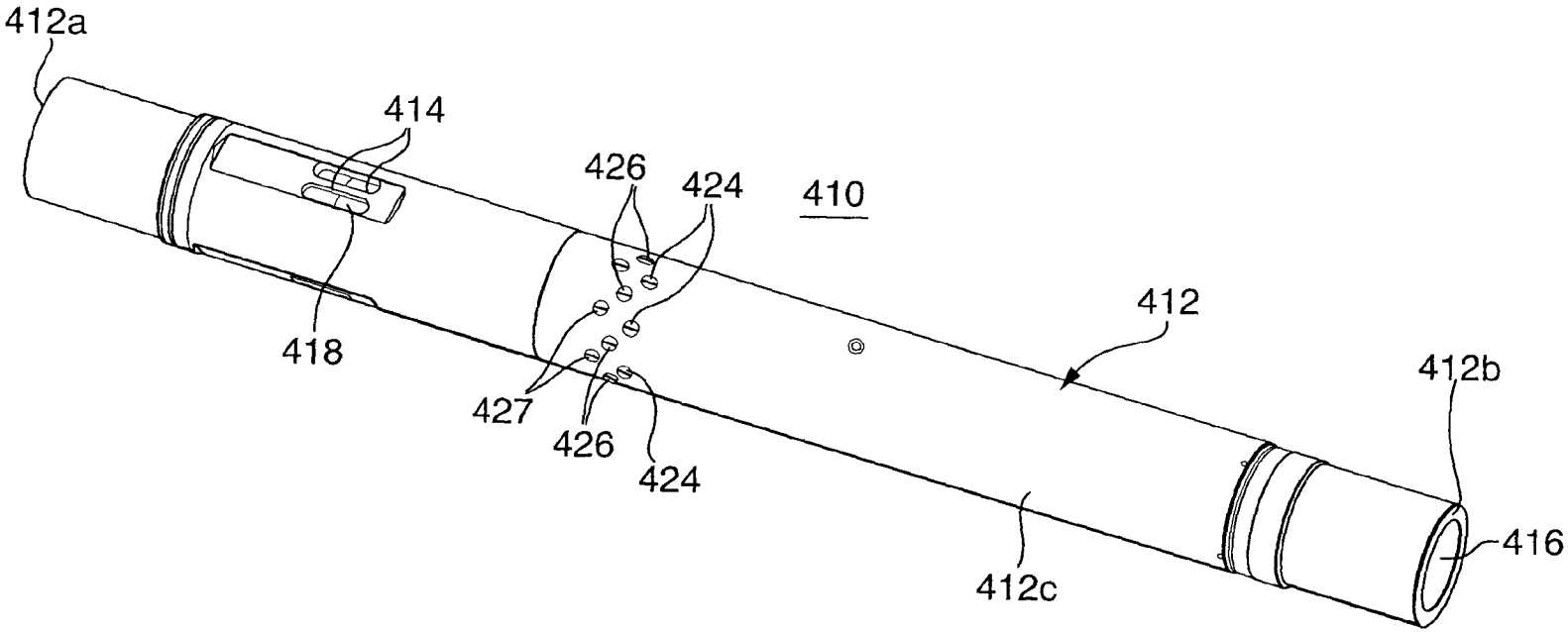
Figure 7B:
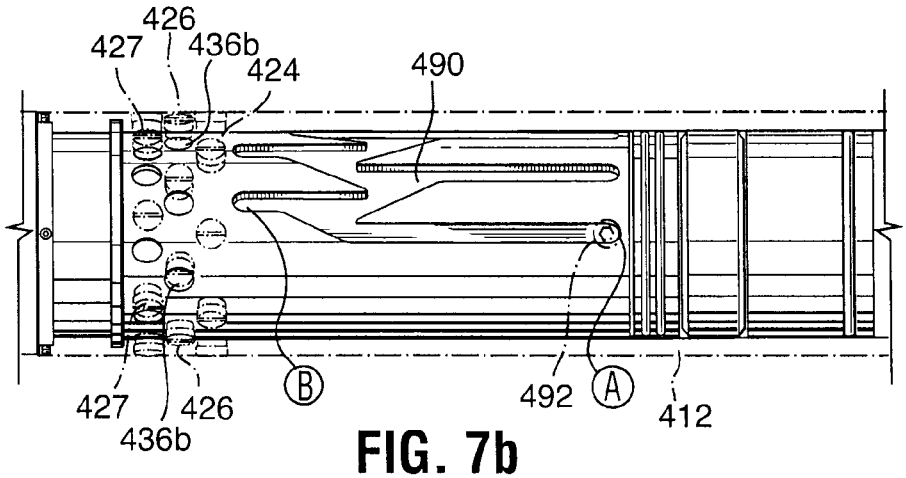
Figure 7C:
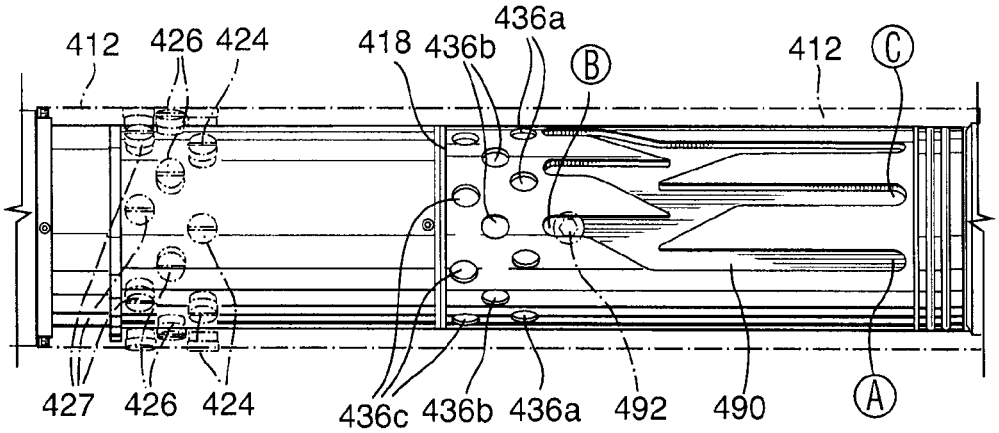
Figure 7D:
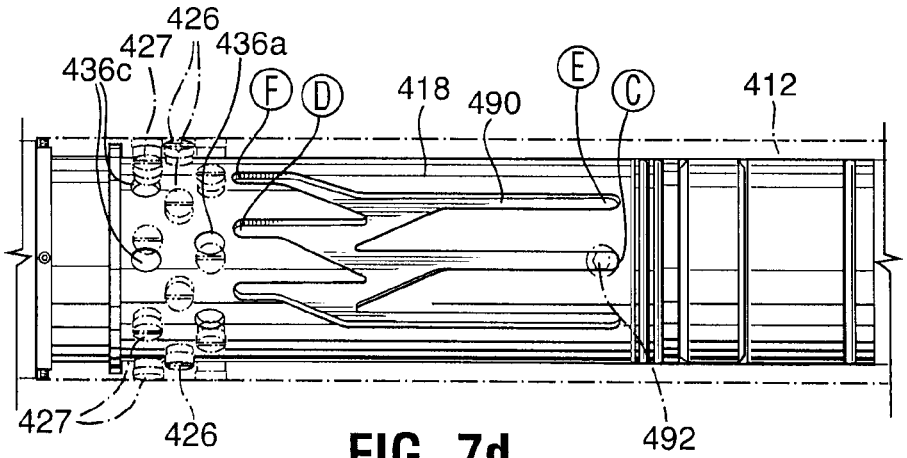
Figure 8A:
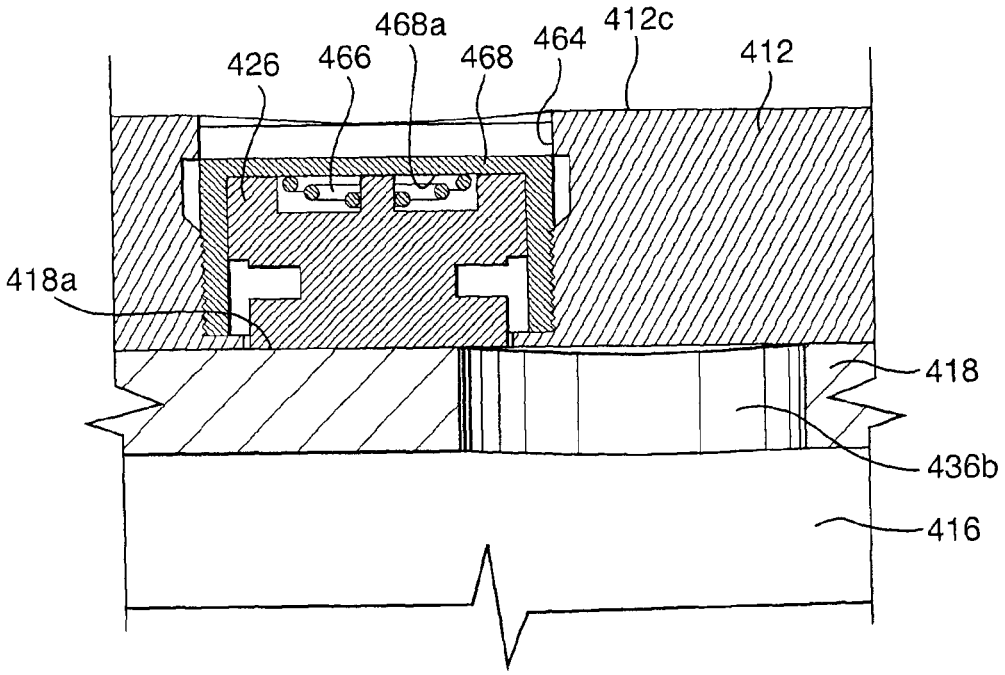
Figure 8B:
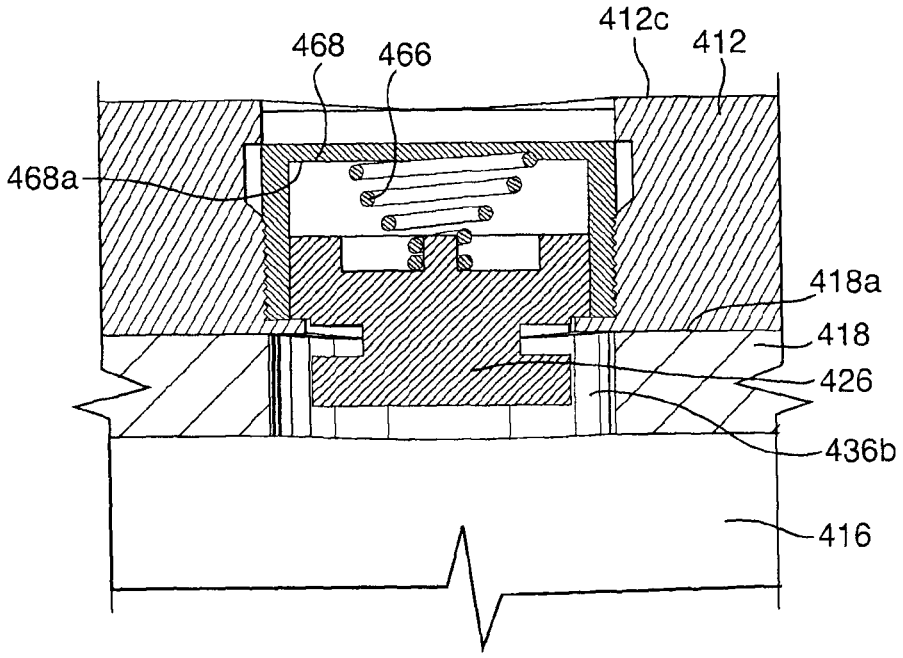

FIGS. 7*a* to 7*d* are sequential sectional views through another refracturing tool; and FIGS. 8*a* and 8*b* are enlarged, sequential sectional views through the shear pin of FIGS. 7*b* and 7*c*, respectively.

DETAILED DESCRIPTION OF VARIOUS EMBODIMENTS

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A sliding sleeve valve may be employed for a plurality of fluid treatments of a subterranean formation including an initial fluid treatment and a second fluid treatment. The second fluid treatment may be conducted without requiring an intervention to reopen the sleeve (i.e. without requiring a run-in operation with a tool on a string to reopen the sleeve).

Fluid treatment, such as stimulation, may be conducted through the sliding sleeve valve wherein fluid is introduced through a string in which the sliding sleeve valve is installed and may be directed to an annular area about the sliding sleeve valve by driving the sleeve to move and open a port covered by the sleeve. The sleeve includes a ball seat on its inner diameter and can be driven by hydraulic force generated by sealing the sleeve with a ball or other plug form, seated in the ball seat. In so doing a pressure differential is established across the ball/seat wherein pressure uphole is greater than that downhole. This forces the sleeve to overcome any initial holding mechanism and moves it to the low pressure side. Movement of the sleeve opens one or more ports covered by the sleeve.

Once the initial stimulation is complete the sliding sleeve valve can provide a means of re-stimulation through the same ports by movement of the sleeve again by hydraulic force, for example, by again dropping a ball to land in the sleeve. Thus, the sleeve can be driven by utilizing the same driving force and fluid diversion method as for the initial stimulation.

With reference to FIGS. 1*a* to 1*j*, a sliding sleeve valve 10 has a tubular form including a tubular wall 12 with ends 12*a*, 12*b* formed for connection to adjacent tubulars to form a tubing string. Although not shown, sliding sleeve valve 10 may, for example, be formed as a sub with threaded ends for installation as by threaded connection to adjacent tubulars in a string.

The sliding sleeve valve further includes at least one port 14 through the tubular wall providing access between an inner bore 16 of the valve and an outer surface 12*c* of the wall. A sleeve 18 is positioned in the inner bore 16 and is moveable to open and close port 14. In the closed position, the sleeve covers the port and in the open position, the sleeve is moved to expose the port to communication thereto from the inner bore. Sleeve 18 includes a ball seat 20 on its inner diameter, which is exposed in the inner bore, providing a means for opening the sleeve by landing a ball 22 or other plug form, on the seat and creating a pressure differential above and below the ball/seat to overcome an initial holding mechanism 24 holding the sleeve in the closed position. When initial holding mechanism 24 is overcome, the sleeve can be moved to the open position.

In addition to initial holding mechanism 24, the tool includes a second holding mechanism 26 for the sleeve valve. The second holding mechanism is initially in an inactive position but becomes activated when the sleeve is reclosed. When activated, the second holding mechanism holds the sleeve closed, covering port 14, and readies the sleeve for reopening by landing a ball on the seat and creating a pressure differential above and below the ball/seat to overcome the second holding mechanism to move the sleeve from the closed position to the open position.

Initial holding mechanism 24 may include a releasable mechanism that can be overcome by applying axially directed force to the sleeve, as occurs when a ball lands in the seat and pressure builds up above the ball/seat. Such a releasable mechanism may include a catch, such as a latch or protrusion on either the sleeve or the wall, engaged behind a shoulder on the other part (sleeve or wall) that releasably holds the sleeve in place in the inner bore, but can be pulled apart to allow the sleeve to move. Alternately or in addition, a mechanism may include a shearing mechanism, such as a shear pin, that releasably holds the sleeve in place in the bore, but can be sheared to allow the sleeve to move. In FIG. 1*a*, initial holding mechanism 24 includes shear stock, such as one or more shear pins connected between the sleeve and the wall.

Second holding mechanism 26 may include a releasable mechanism that when activated holds the sleeve in place in the inner bore but can be overcome release the sleeve for movement by applying axially directed force to the sleeve, as occurs when a ball lands in the seat and pressure builds up above the ball/seat. Such a releasable mechanism may include a catch, such as a latch or protrusion on either the sleeve or the wall, engaged behind a shoulder on the other part (sleeve or wall) that releasably holds the sleeve in place in the inner bore, but can be pulled apart to allow the sleeve to move. Alternately or in addition, the releasable mechanism may include a shearing mechanism, such as a shear pin, that releasably holds the sleeve in place in the bore, but can be sheared to allow the sleeve to move.

The initial holding mechanism and the second holding mechanism respond to similar applications of force to be overcome. For example, they both respond to axial application of force and an amount of force applied by a ball landing in seat While not shown in FIG. 1, in one embodiment the second holding mechanism is the same mechanism, and acts in the same way, as the initial holding mechanism.

In this illustrated embodiment, however, second holding mechanism 26 is separate from the initial holding mechanism. Second holding mechanism 26 is positioned between sleeve 18 and wall 12 before running into the wellbore, but only operates to hold the sleeve in position when the sleeve is reclosed after an initial opening operation. Thus, second holding mechanism 26 is present in the sleeve valve 10 as it is run in the hole, but doesn't become activated and set up until the sleeve is reclosed. This can be achieved, for example, by providing parts of mechanism 26 to engage between the sleeve and the wall 12, but holding them out of alignment until the sleeve is reclosed. In this illustrated embodiment, as shown enlarged in FIGS. 2*a* to 2*c*, second holding mechanism 26 includes a shearing mechanism 30 and a moveable locking device 32 carried between sleeve 18 and wall 12 of the housing. Moveable locking device 32 initially moves with the sleeve and is contained between a stop wall 34 on sleeve 18 and shearing mechanism 30 attached to sleeve 18, but eventually reaches a position, the active position (FIG. 2*b*), where device 32 can create a lock between wall 14 and sleeve 18. In this embodiment, moveable locking device 32 has the form of a snap ring and is biased to expand outwardly when it is free to do so. When in the active position, device 32 moves radially out to engage in a gland, such as annular gland 36 defined by end walls 36*a*, 36*b*. When this occurs, sleeve 18 is held against further movement in at least one direction to the sleeve open position, with shearing mechanism 30 holding the sleeve from moving relative to moveable locking device 32 and end wall 36*b* of the annular gland holding the moveable locking device from moving relative to the wall. It will be appreciated that the thickness of moveable locking device 32 and the formation of the interacting surfaces ensures that device 32 remains locked against each of shearing mechanism 30 and end wall 36*b*. For example, end wall 36*b* of the annular gland and end 32*b* of the moveable locking device are formed at substantially or less than right angles to interact, catch and stop movement past each other. The same is true of the interacting surfaces of ring 30*a* and end 32*a* of the moveable locking device.

After moving into the active position locking between wall 14 and sleeve 18, the locking action of moveable locking device 32 can only be overcome to permit movement of the sleeve by shearing the shearing mechanism 30 such that the sleeve becomes released from moveable locking device 32 (FIG. 2*c*).

While moveable locking device 32 would readily snap out into gland 36, the moveable locking device is maintained out of alignment with the gland until the sleeve is moved into the reclosed position. For example, during run in, as shown in FIGS. 1*b* and 2*a*, sleeve 18 is held by initial holding mechanism 24 in a position with device 32 offset from gland 36, for example with a small gap between sleeve 18 and the upper limit of its travel as established by stop shoulder 39. The movement thereafter of sleeve to the open position is down, thus moving device 32 further away from gland. Only when the sleeve is reclosed and moved up past its original run in position closer to, for example against, shoulder 39 will the moveable locking device be moved to a position overlying gland 36.

If there are other grooves in wall 12, such as groove 45, into which the moveable locking device 36 may expand, these grooves may be formed with ramped end walls 45*b* such that the locking device may readily move out of them.

While an embodiment is shown for illustrative purposes, it is to be appreciated that various modifications can be made. For example, while shearing mechanism 30 is illustrated as a ring 30*a* secured by shear pins 30*b* on the sleeve, it is to be appreciated that the shearing mechanism could take other forms such as just a plurality of shear pins positioned on the sleeve or a plurality of shear pins passing through the body of device 36. Similarly, the moveable locking device, while illustrated as a snap ring, may include a plurality of detents, etc. Also, the location of the structures on the sleeve and the wall may be reversed.

Sleeve valve 10 may further include a releasable locking structure 42 for releasably holding the sleeve in the open and/or the closed positions. In the illustrated embodiment, releasable locking structure 42 includes a snap ring carried on the sleeve 18 and which is releasably landable in glands 44, 45 in the wall when the structure is moved to a position over the glands. Structure 42, while biased to expand out, it can be compressed radially inwardly to be removed from the gland by movement of the sleeve. Thus, while the holding force of structure 42 in a gland is sufficient to prevent the unintentional migration of the sleeve, the holding force can be readily overcome by smaller applied forces such as with a shifting tool. For example, structure can be employed to effect a holding force of less than 18,000 lbs for example in one embodiment of about 5,000 to 10,000 lbs, which is about ⅛ to ¼ the holding force that is generally of interest for the initial and second holding mechanisms.

For example, the ends 42*a*, 42*b* of the releasably locking structure and/or the end walls 45*a*, 45*b* of the gland can be formed, as by angling as shown, to allow the structure to more easily pull out of engagement when a suitable force is applied. In this embodiment, the holding force of structure 42 in gland 45 is minimal compared to the holding force of mechanism 24 or mechanism 26. The mechanisms 24, 26 offer the more significant resistance to the movement of sleeve 18 and offer resistance requiring a known force to be overcome.

Sleeve 18 may further include one or more inner grooves 46, 48 for permitting engagement of the sleeve with a shifting tool.

Sleeve valve 10 may include seals between the sleeve and the wall that seal fluid passage to port 14 when the sleeve is closed and/or seals in other locations that protect against infiltration of damaging debris.

Sleeve valve 10 may include an anti-rotation device, such as a torque pin/slot (not shown) to prevent the sleeve from spinning about the long axis of the housing.

The sliding sleeve valve of FIG. 1 can be employed to permit a wellbore fluid treatment therethrough, then closed and reopened for a further fluid treatment: refracing for example. Both the opening and the reopening can be achieved by use of a ball released to land in the seat of the sleeve. The operator can shift the sleeve valve open twice, each time with a ball. The operator can close the ports using a shifting tool after the initial stimulation, but the ports can be reopened with a ball. The operator can, therefore, refracture the formation accessed through the sliding sleeve valve after the original production has started to decline. The process is as follows:

FIGS. 1*a* and 1*b*: Run a completion string 50 into a wellbore 52 including a sliding sleeve valve 10, the sliding sleeve valve having a wall 12 defining an inner diameter 16 and an outer surface 12*c*. The inner diameter and the outer surface are incorporated in the string such that inner diameter 16 is open to the inner diameter of the string 50. A port 14 extends through wall 12 to permit fluid to be passed from the inner bore to the outer surface; and a sleeve 18 is moveable relative to the port to open and close it. The sleeve valve has a ball seat 20 exposed in its inner diameter which can catch and seal with a ball 22 introduced to the inner bore. The sleeve valve is moveable to expose port 14 to fluid flow therethrough when the ball is caught and sealed against seat 20.

During run in, port 14 is closed by sleeve 18 and an initial holding mechanism 24 holds the sleeve in this closed position.

The tool further has a second holding mechanism 26 that, after reclosing, holds the sleeve 18 reclosed such that by use of the seat, the sleeve can be reopened. During run in, second holding mechanism 26 is maintained in an inactive position such as that shown in FIG. 2*a*. For example, in the embodiment illustrated, a moveable locking device 32, while biased radially outwardly, is contained in an inwardly compressed condition against wall 12. Moveable locking device 32 moves with the sleeve and is contained between a stop wall 34 on sleeve 18 and a shearing mechanism 30 attached to sleeve 18.

The completion string may include more than one sliding sleeve valve, such as sliding sleeve valves 10*a*, at least some of which may be operable by dropping balls. If completion string 50 includes a plurality of ball actuated sliding sleeve valves, the seats may be sized sequentially such that different sized balls open one or more different sleeves, with the smallest ball intended to open the lowest sleeve valve 10, which is that closest to bottom hole. The sleeve valve of FIG. 1*b* can be adapted to work with any particular diameter of ball by replacing the seat with one of an appropriate diameter.

The completion string may be positioned in various areas of the wellbore. In one embodiment, the string is positioned with the port of valve 10 adjacent an open hole (uncased) region of wellbore, possibly in a horizontal section of the well. After completion string 50 is positioned, it is set in the wellbore. For example, a liner hanger may be set and/or one or more packers 54 may be set in the annulus 56 about the string.

Figure 1C:
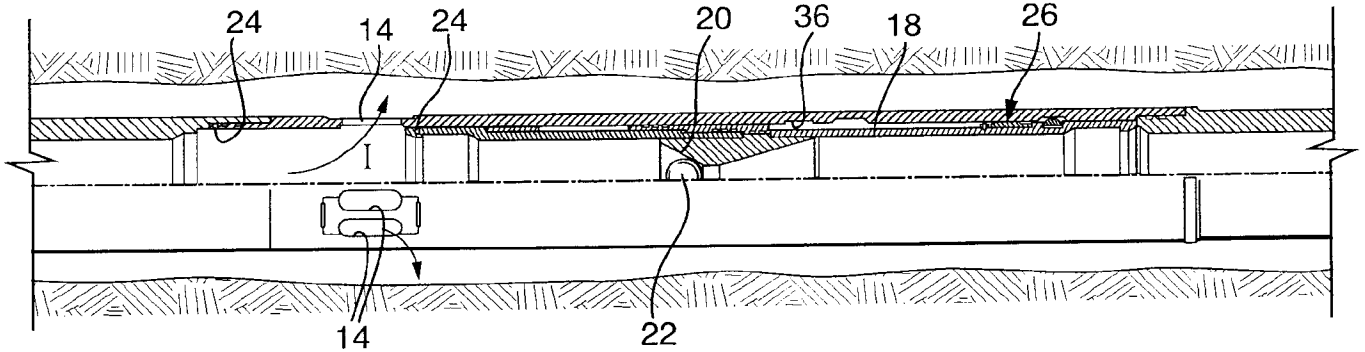

FIG. 1*c*: When it is desirable to access the wellbore through port 14, a ball 22 is dropped to land in ball seat 20 and the string is pressured up to actuate the sleeve valve to move axially down to open the port. The ball creates a large restriction with seat 20. Movement of the sleeve is only permitted after the initial holding mechanism 24 is overcome by sufficient force applied hydraulically.

Inject fluid, arrows I, through the inner diameter of string 50 to inner diameter 16 and out though port 14 to stimulate the formation at this stage, for example, between adjacent packers. Fluid is diverted out through port 14, as it is stopped from further advancement through the string by ball 22 landed in seat 20.

Figure 1D:
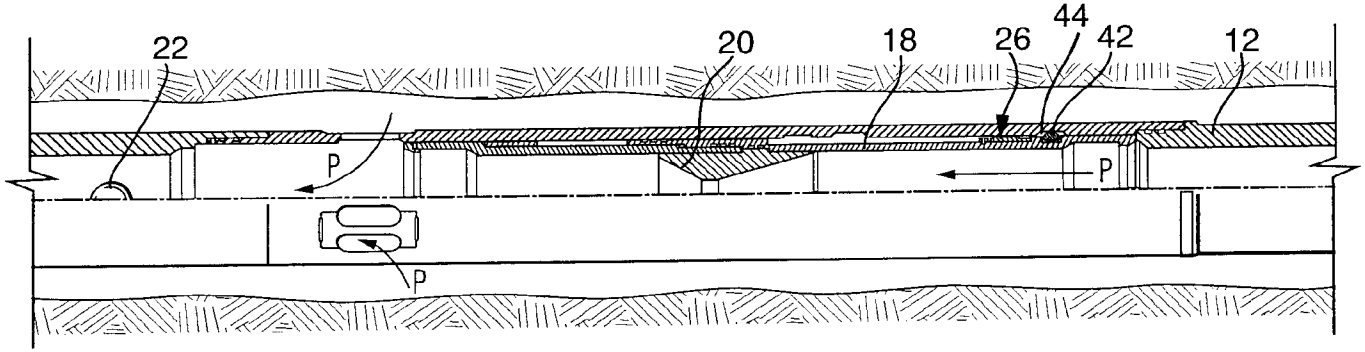

FIG. 1*d*: The well is put on production and ball 22 flows out with produced fluids (arrows P). Port 14 remains open and any movement of sleeve 18 to reclose port is resisted by the position of releasable lock 42 in gland 44.

Figure 1E:
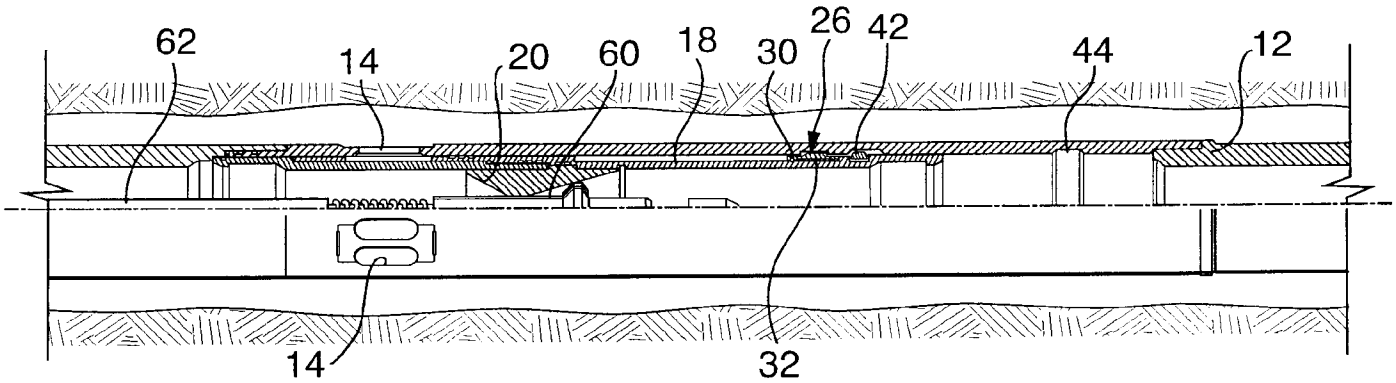

FIG. 1*e*: When desired, the sleeve valve may be closed to close the port. Closing is achieved with a shifting tool 60 run in on a string 62, such as coiled or jointed tubing, to move the sleeve valve. In one embodiment, the shifting tool is run in from surface, moved through the seat and pulled to surface. On the way out of the hole, the shifting tool catches on sleeve 18, such as against the underside of seat 20, and moves sleeve 18 up to a closed position. If it is desired to close the sleeves of other valves 10*a*, such as to refracture all stages accessed by valves 10*a*, the shifting tool can close all of the sleeves of other sliding sleeve valves 10*a* in the completion string with one trip to surface. The sleeves may be closed to shut off production or for other reasons such as a desire to restimulate the formation in stages. While the sleeve is held open by ring 42 landed in groove 44, sufficient force can be applied by tool 60 to urge the ring to be compressed inwardly, as by interaction of the ramped surface 42*a* to ride up out of the gland.

The closing process activates the second holding mechanism allowing the sliding sleeve valve 10 to function just as it did during the first stimulation: to be openable by landing a ball on seat 20. With reference also to FIG. 2*b*, movement of sleeve 18 up by shifting tool 60 moves moveable locking device 32 to an active position where it becomes engaged and creates a lock between wall 14 and sleeve 18. In this embodiment, the shifting tool moves the sleeve up until the sleeve's movement is stopped. This may be until the moveable locking device 32, which moves with sleeve 18, is in a position overlying gland 36 and in this embodiment, coincides with the position of shoulder 39. When moveable locking device 32 is positioned over gland 36, the bias in device 32 snaps it out into the gland. When this occurs, sleeve 18 is held against further movement axially towards bottom hole, since shearing mechanism 30 holds the sleeve from moving relative to the moveable locking device and end wall 36*b* of the annular gland holds the moveable locking device from moving relative to the wall.

The second holding mechanism is engaged into the active position without removing the ball seat. Ball seat 20 is still intact.

Figure 1F:
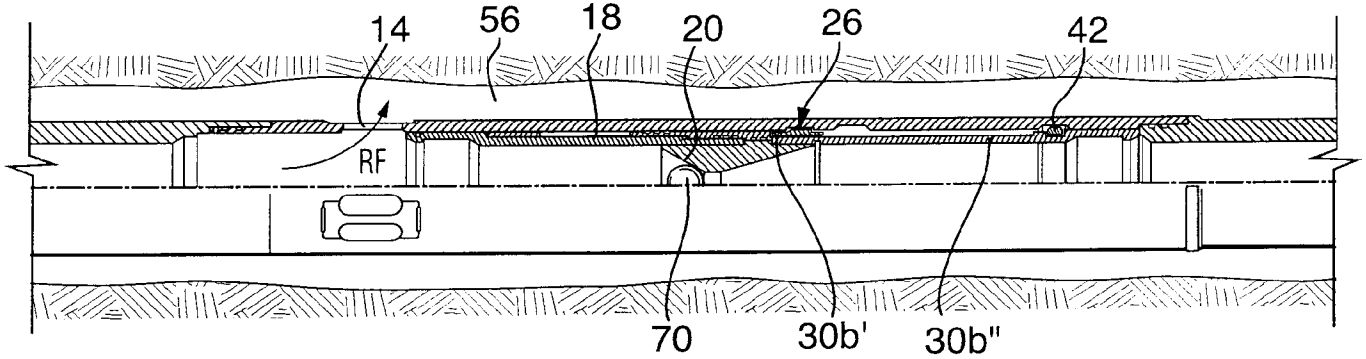

FIG. 1*f*: If it is desired to reopen port 14, for example, to refracture the formation, a ball 70 is dropped to land on seat 20, move the sleeve 18 and open the port. Ball 70 is similar if not identical to ball 22. With reference to FIG. 2*c*, while sleeve 18 is held by the second holding mechanism 26, the holding force of that mechanism can be overcome when sufficient hydraulic force is applied through seat 20 to sleeve. In particular, the sleeve is permitted to move by shearing the shearing mechanism 30 such that the sleeve becomes released from moveable locking device 32. For example, when sufficient force is applied by sleeve 18 through shearing mechanism 30 to device 32, the shearing mechanism, such as pins 30*b*, fail (after shearing see parts 30*b*', 30*b*") such that ring 30*a* can slide along the outer surface of sleeve 18, but will not stop movement of sleeve 18 relative to device 32.

Sleeve 18 moves until it becomes stopped against shoulder 43, at which point ring 42 drops into gland 44.

Fluids may be injected, arrows RF, through port 14 and into contact with the formation exposed in the wellbore.

Figure 1G:
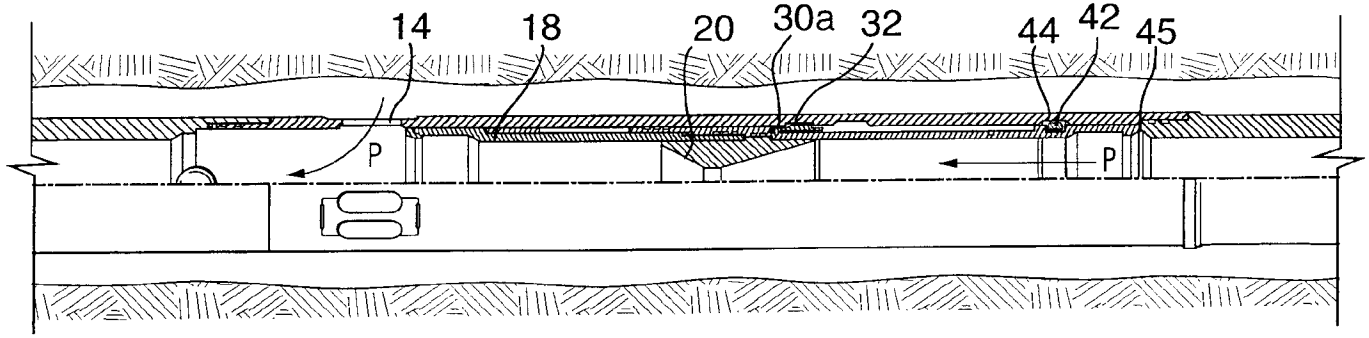

FIG. 1*g*: Optionally, after the stimulation operation, the ball is allowed to flow out of the well and the well is allowed to produce, arrows P, until the production starts to deplete. Alternately, after opening the sleeve and the treatment is effect through the port, the sleeve could be closed right away.

Figure 1H:
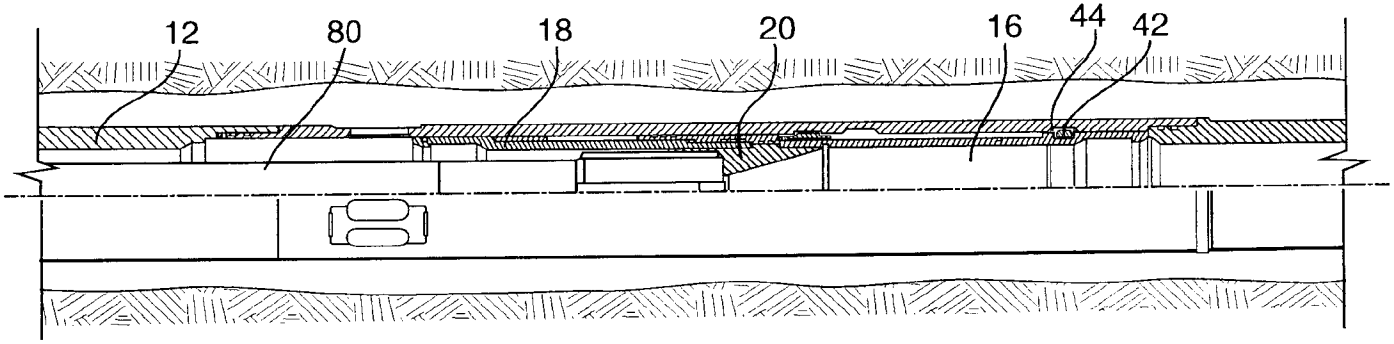

FIG. 1*h*: If desired, the operator can mill out the seats 20 by a milling tool 80 providing full bore access to the well. An anti-torque device may be useful to hold the sleeve against rotating with the mill.

Figure 1I:
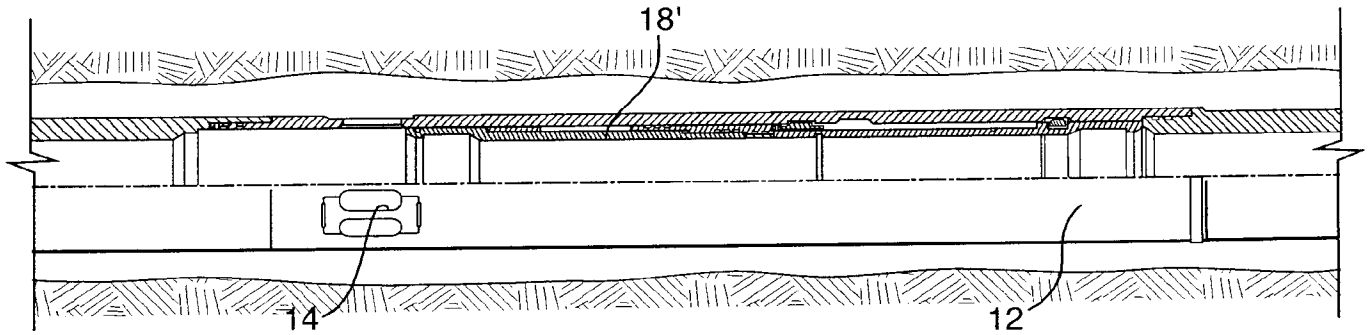

FIG. 1*i*: After the seats are milled out, sleeve 18' can then remain open for production through port 14 or can be closed for selective isolation.

Figure 1J:
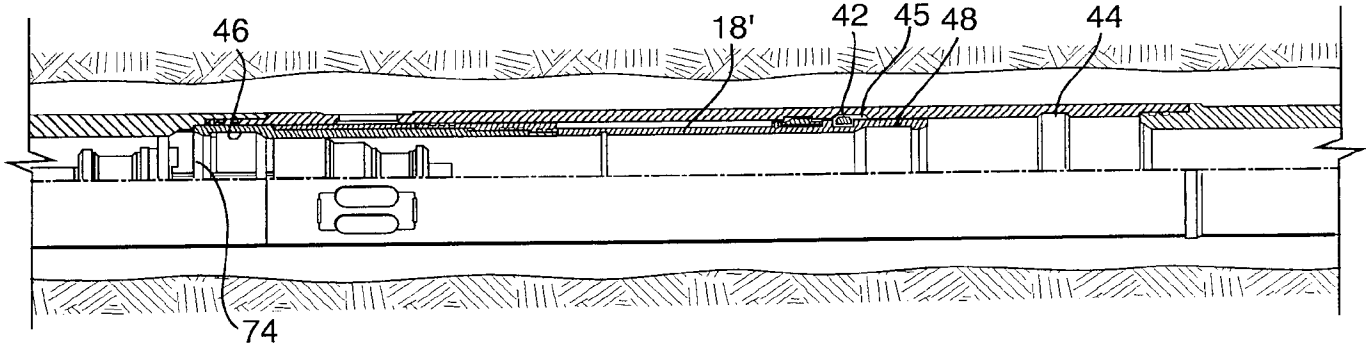

FIG. 1*j*: A shifting tool 74, such as a standard B shifting tool, can be employed to open and/or close sleeve 18' at least after the ball seat 20 is removed. Shifting tool 74 engages in inner grooves 46 and/or 48. Holding device 26, being overcome previously, has no effect on the sleeve movement and simply slides along the outer surface of the sleeve 18'. Releasable lock structure 42 can be landed in grooves 44 and 45 to hold the sleeve against migration out of the open position and closed position, respectively. While the interaction of releasable lock 42 with these grooves does resist inadvertent movement, the force applied through shifting tool readily overcomes the locking force of lock 42 and moves the sleeve.

As noted above, a single releasable locking mechanism can in some embodiments operate as both the initial holding mechanism and the second holding mechanism. As shown in FIGS. 3*a* to 3*e*, for example, a single mechanism 126 operates both to hold the sleeve 118 initially closed and then to hold sleeve 118 reclosed. Holding mechanism 126 may include a releasable locking mechanism such as a collet 130 installed in wall 112 of the sleeve valve's tubular housing, which has fingers with dogs 132 thereon that releasable lock into a gland 136 on sleeve 118. Collet dogs 132 and gland 136 are correspondingly positioned such that when the sleeve is closed or reclosed, the collet dogs locate and releasably lock in the gland. Dogs 132 can be formed, as by angling their protruding faces such that, after becoming locked in gland 136, they can only be removed by applying considerable axial force to pull them out of the gland. With a holding mechanism such as this, the sleeve can be opened and reclosed a number of times. However, care must be taken to ensure the dogs and the gland are durable and carefully formed to ensure that the force to open the sleeve remains consistent to avoid accidental opening or accidental failure by failing to lock or release. Of course, the holding mechanism could be reversed so that the collet is secured to and moveable with the sleeve and includes dogs that releasably lock into a gland on the tubular wall.

A small back-up releasable locking structure can be provided by a snap ring 142 landable in grooves 144, 145. While ring 142 can provide minimal resistance to natural migration of the sleeve, it doesn't provide the same degree of holding force of collet 130.

Sleeve valve 110 may include seals 174 between the sleeve and the wall that seal fluid passage to ports 114 when the sleeve is closed and/or seals 176 in other locations that protect bypass of fluid and/or against infiltration of damaging debris.

Figure 3A:
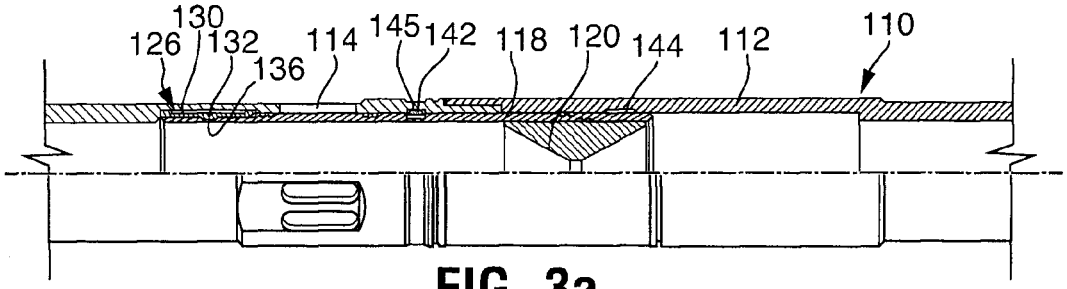
Figure 3B:
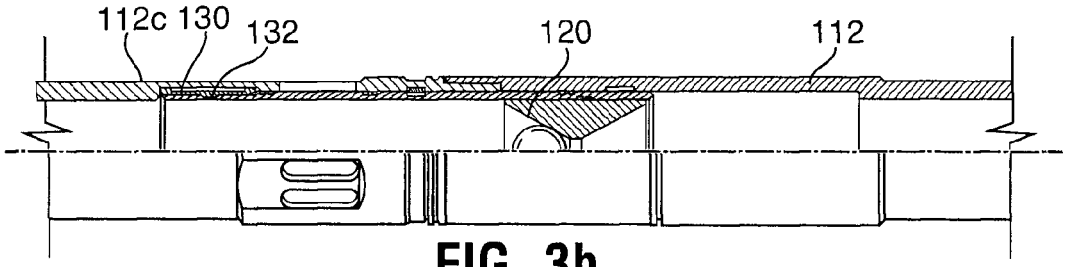
Figure 3C:
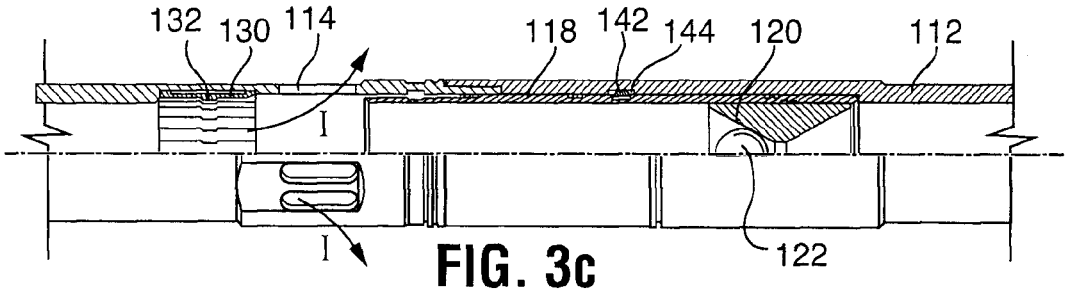
Figure 3D:
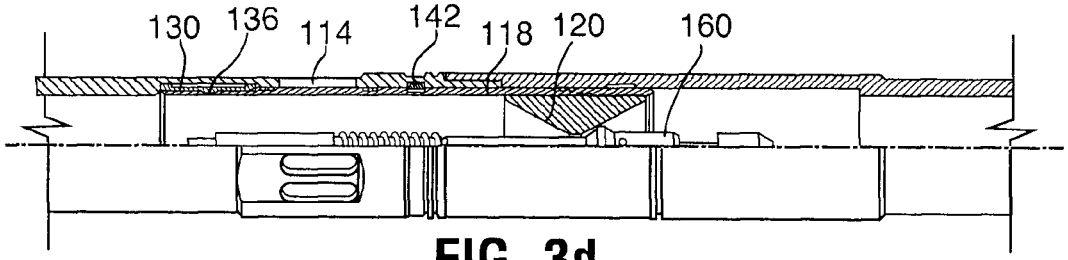
Figure 3E:
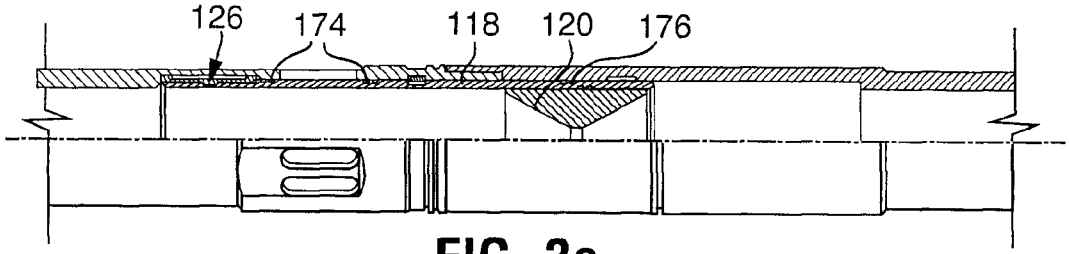

The drawings show the operations of the illustrated sliding sleeve valve 110, which may be installed in a string (not shown) by connection of adjacent tubulars on its ends and run into a well. During run in, as shown in FIG. 3*a*, sleeve 118 is secured over ports 114 in wall 112 by holding mechanism 126 with dogs 132 of collet 130 engaged in gland 136 of sleeve 118. Once the sliding sleeve valve 110 and the string in which it is secured are in position (FIG. 3*b*), a ball 122 may be dropped to land in a seat 120 on the sleeve. Once ball 122 has landed and sealed against seat 120, a pressure differential can be established by continued pumping that forces the sleeve down to the low pressure side. Collet force between collet 130 and gland 136 of the sleeve, must be overcome by the pressure acting across the piston area formed after the ball hits the seat. When collet force is overcome (FIG. 3*c*), sleeve 118 pulls out of engagement with the collet dogs 132 and moves down to open ports 114 to fluid flow therethrough, arrows I, from inner bore 116 toward outer surface 112*c* and into contact with the formation. As shown in FIG. 3*d*, when it is desirable to reclose the sleeve, such as when it is useful to refracture the formation, a shifting tool 60 may be run through the string to move the sleeve up to close ports 114 and reengage the collet dogs 132 with gland 136. As shown in FIG. 3*e*, once the shifting tool is removed, sleeve 118 is ready for reopening, as by landing a next ball against seat 120, which will overcome the collet force holding dogs 132 in sleeve 118 and move the sleeve to open ports 114.

In one embodiment as shown in FIG. 4, the initial and second holding mechanisms are ratchets. The same ratchet 226 is employed for both the initial holding and the second holding of sleeve 218. As shown in FIGS. 4*a* to 4*e*, for example, a single mechanism, ratchet 226, operates both to hold the sleeve 218 initially closed and to hold it reclosed. Ratchet 226 provides a releasable locking mechanism through a collet structure 230 installed on wall 212 of valve's tubular housing, which has fingers with teeth 232 thereon that releasable lock with annular teeth 236 on sleeve 218. The teeth 232 and teeth 236 are correspondingly positioned such that when the sleeve is closed or reclosed, the teeth locate and releasably lock together. Teeth 232 and 236 can be formed, as by angling their protruding faces such that, after becoming locked together, they can only be removed by applying considerable axial force to pull them out of engagement with each other, along with an expansion provided by collet structure 230 on which teeth 232 are formed. With a holding mechanism such as this, sleeve 218 can be opened and reclosed a number of times. However, care must be taken to ensure the teeth are durable and carefully formed to ensure that the force to open the sleeve remains consistent to avoid accidental opening or accidental failure by failing to lock or release. Of course, the holding mechanism could be reversed so that the collet structure is secured to and moveable with the sleeve.

A small back-up releasable locking structure can be provided by a snap ring 242 landable in grooves 244, 245. While ring 242 can provide minimal resistance to natural migration of the sleeve, it doesn't provide the same degree of holding force as that of collet 230.

A torque pin 282 is positioned in a slot 284 to prevent the sleeve from rotating within the wall of the housing about the long axis of the housing, as is useful during milling of the seats.

Figure 4A:
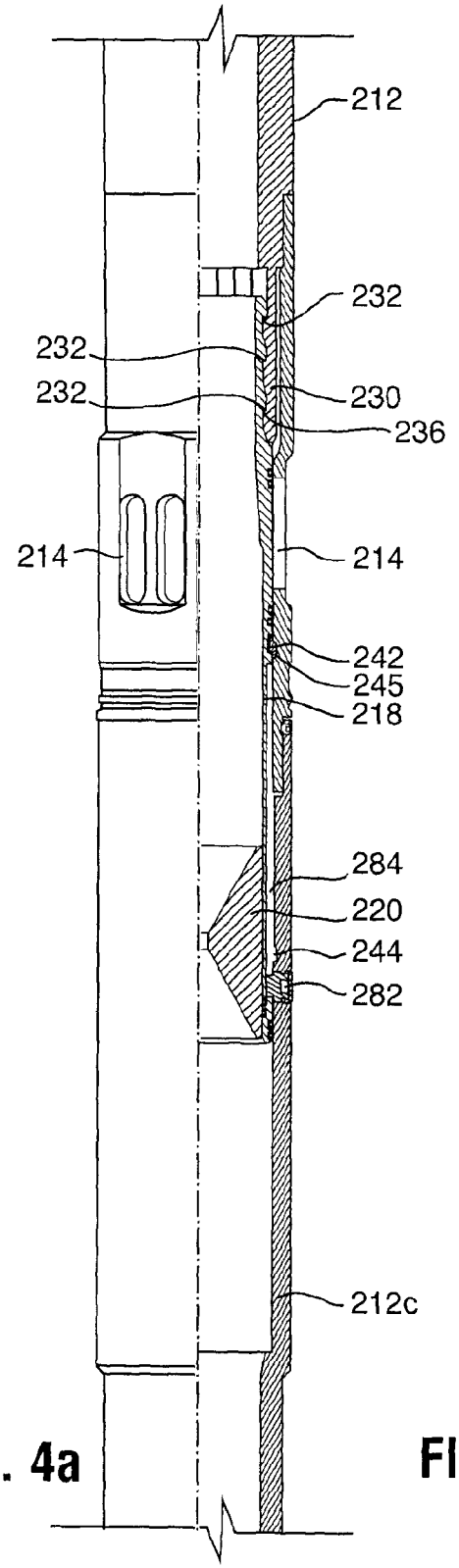
Figure 4B:
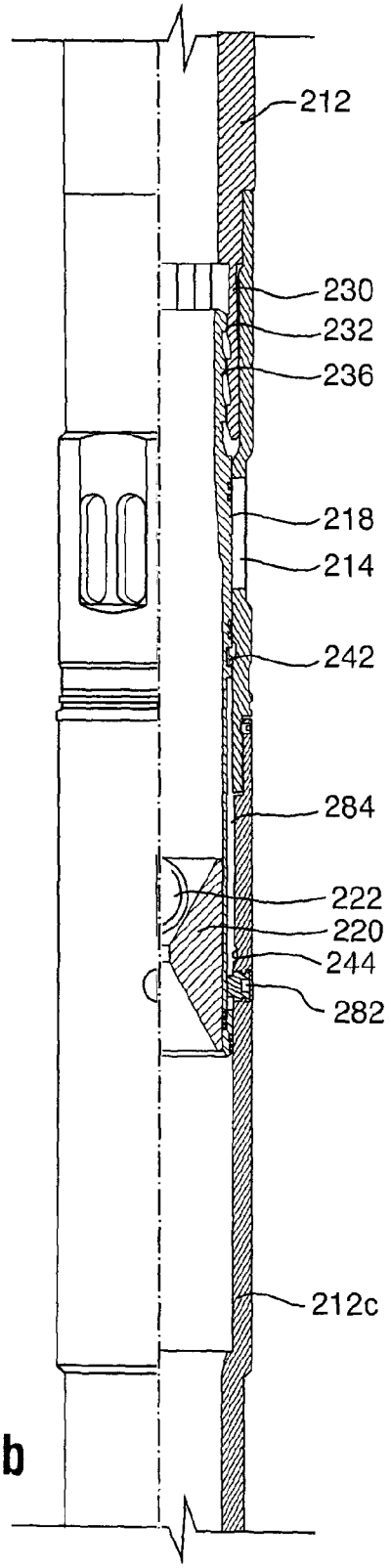
Figure 4C:
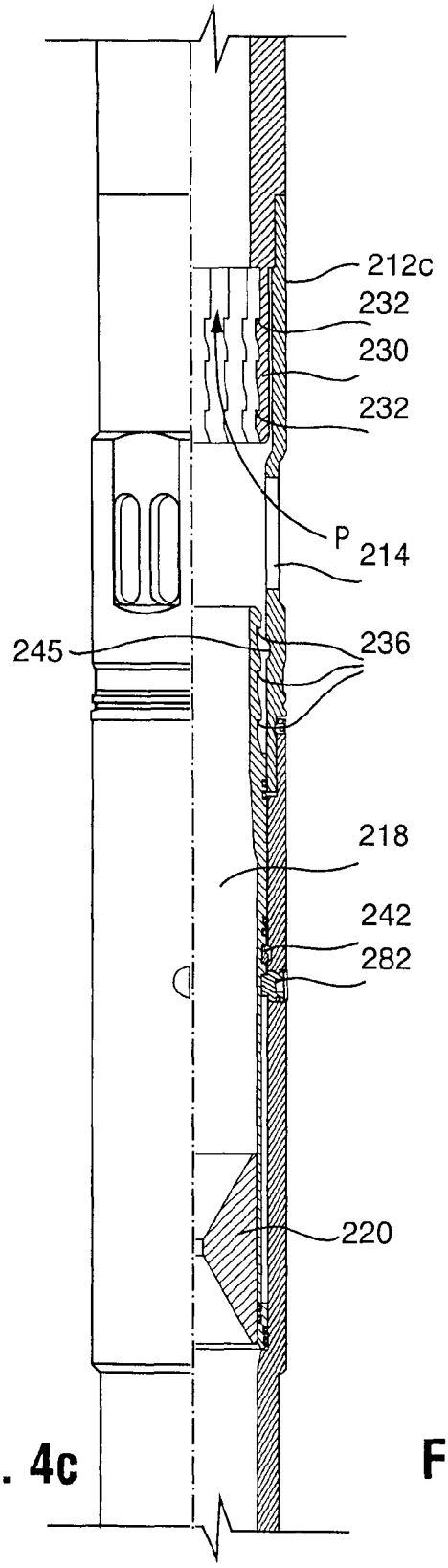
Figure 4D:
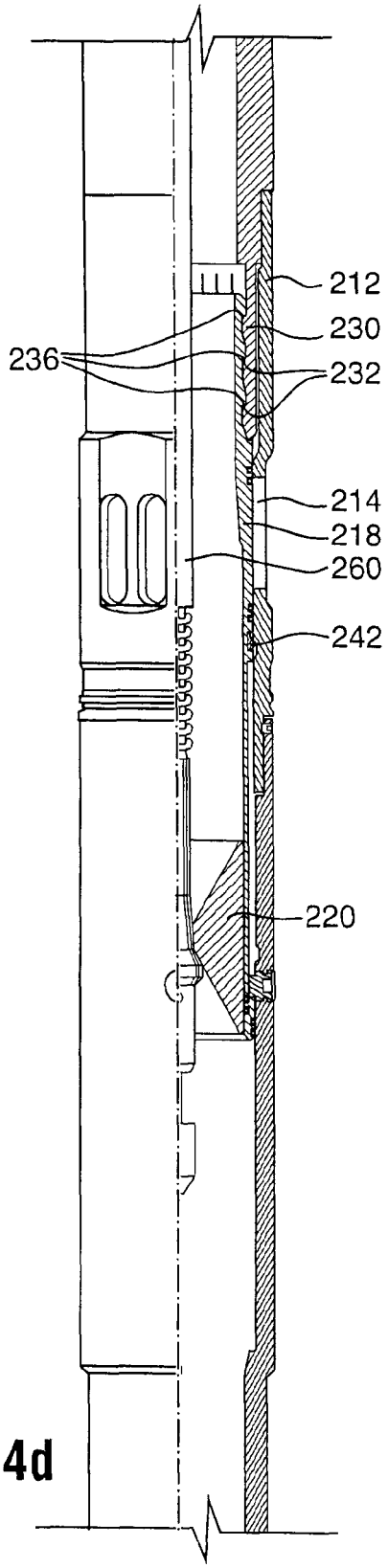

The drawings show the operations of the illustrated sliding sleeve valve 210, which may be installed in a string (not shown) by connection of adjacent tubulars on its ends and run into a well. During run in, as shown in FIG. 4*a*, sleeve 218 is secured over ports 214 in wall 212 by holding mechanism 226 with teeth 232 of collet structure 230 engaged with teeth 236 on sleeve 218. Once the sliding sleeve valve 210 and the string in which it is secured are in position (FIG. 4*b*), a ball 222 may be dropped to land in a seat 220 on the sleeve. Once ball 222 has landed and sealed against seat 220, a pressure differential can be established by continued pumping that forces the sleeve down to the low pressure side. The holding force between teeth 232 and 236, must be overcome by the pressure acting across the piston area created after the ball hits the seat. When the holding force is overcome (FIG. 4*b*), sleeve 218 pulls out of engagement with teeth 232 and moves down to open ports 214 to fluid flow therethrough from inner bore 216 toward outer surface 212*c* and into contact with the formation. As shown in FIG. 4*c*, once open, produced fluids, arrows P, can flow in through ports 214 and ball 222 will flow back to surface. The sleeve is held open by engagement of snap ring 242 in gland 244. When it is desirable to reclose the sleeve, such as when it is useful to refracture the formation, a shifting tool 260 may be run through the string to move the sleeve up to close ports 214 and reengage teeth 232 on the housing with teeth 236 on the sleeve (FIG. 4*d*). Once the shifting tool is removed, sleeve 218 is ready for reopening, as by landing a next ball against seat 220, which will overcome the force holding teeth 232 and 236 in engagement to reopen ports 214.

Systems using shear stock as both the initial holding mechanism and the second holding mechanism are preferred because of the greater reliability and repeatability that can be achieved. Such a system is shown in FIG. 1*b*. In another embodiment, for example, as shown in FIGS. 5 and 6, the initial and second holding mechanisms are two sets of shear pins 324, 326, albeit each set with similar properties. For example, the tool can include a plurality of shear pins in an array such that after a first set of shear pins 324, which act to hold the sleeve 318 in the run in position, is overcome (i.e. sheared), sleeve 318 can be reset to a reclosed position to be secured by a second set of shear pins 326 of the array. In addition to the two sets, one or more further sets 327, 328 of shear pins can be provided in the array to allow the sleeve to be reset a number of further times.

With closer reference to FIG. 5, a sliding sleeve valve 310 has a housing with a tubular form including a tubular wall 312 with ends 312*a*, 312*b* formed for connection to adjacent tubulars to form a tubing string. Although not shown, sliding sleeve valve 310 may, for example, be formed as a sub with threaded ends for installation as by threaded connection to adjacent tubulars in a string.

The sliding sleeve valve further includes at least one port 314 through the tubular wall providing access between an inner bore 316 of the valve and an outer surface 312*c* of the wall. A sleeve 318 is positioned in the inner bore 316 and is moveable to open and close port 314. In the closed position, the sleeve covers the port and in the open position, the sleeve is moved to expose the port to the inner bore. Sleeve 318 includes a ball seat 320 on its inner diameter, which is exposed in the inner bore, providing a means for opening the sleeve by landing a ball 322 or other plug form, on the seat and creating a pressure differential above and below the ball/seat to overcome an initial holding mechanism including a plurality 324 of shear pins holding the sleeve in the closed position. When the initial holding mechanism is overcome, the sleeve can be moved to the open position.

In addition to the initial holding mechanism, the tool includes a second holding mechanism including a plurality 326 of shear pins for the sleeve valve. The second holding mechanism is initially in an inactive position but becomes activated when the sleeve is reclosed. When activated, the second holding mechanism holds the sleeve closed, covering port 314, and readies the sleeve for reopening by landing a ball on the seat and creating a pressure differential above and below the ball/seat to overcome the second holding mechanism to move the sleeve from the closed position to the open position.

The holding mechanisms including the plurality of shear pins 324 and 326 can each be overcome by applying axially directed force to the sleeve, as occurs when a ball lands in the seat and pressure builds up above the ball/seat.

The initial holding mechanism and the second holding mechanism can have shear stock selected to respond to similar applications of force to be overcome. For example, they both respond to axial application of force and an amount of force applied by a ball landing in seat 320. In one embodiment, the number and rating of shear pins can be substantially identical in the two sets 324, 326.

Each set of shear pins may include a plurality of spaced apart pins arranged in a ring around a circumference of the sleeve valve, either in the sleeve or in wall 312, as shown. Each set of pins is spaced axially from an adjacent set of pins. For example, set 324 together form a ring around wall 312 and are axially offset from the ring of pins forming set 326.

In the illustrated embodiment, there are further sets 327, 328 that each include a plurality of pins arranged about the circumference of the tool and are each axially offset a different distance from set 326.

Each pin in each set is installed in a port and is biased outwardly from that port. With reference also to FIG. 6, for example, each pin in each set, such as pin 324*a* in the set for initial holding, is installed in a port 364 and is biased outwardly by a spring 366 from that port by the action of the spring pushing pin 324*a* away from an end wall 368*a* of the port. In this embodiment, end wall 368*a* is a surface of a threaded plug 368 installed in the port.

The pins are biased out from their ports such that they are pushed against the outer surface of sleeve 318 and protrude into any opening that becomes aligned below them. Thus, the sleeve can be held by the pins against axial movement by placement of an opening such as slot 336 into alignment with the pins and into which the pins are biased to protrude. The slot 336 can be formed to follow the circumferential arrangement of the sets of pins, but to have a width to only allow one set of pins to protrude into the slot at one time.

Slot 336 may have an open inner end 336*a* through which a sheared portion 324*a*" of any shear pin can pass.

Pins 326 of the second holding mechanism, while similar in form, rating, etc., are separated axially from pins 324 of the initial holding mechanism. While pins 326 are positioned between sleeve 318 and wall 312 before running into the wellbore, they only operate to hold the sleeve in position when the sleeve is reclosed after an initial opening operation which shears pins 324. Thus, pins 326 don't become activated and set up to engage the sleeve until the sleeve is reclosed. The inactive positioning of pins 326 is achieved by maintaining them out of alignment with slot 336 until the sleeve is reclosed.

For example, while pins 326 are biased to readily pop out into slot 336, pins 326 are maintained out of alignment with the slot 336 until the sleeve is moved into the reclosed position. For example, during run in, as shown in FIGS. 5*a* and 6, sleeve 318 is held by the pins 324 of the initial holding mechanism in a position with those pins protruding into slot 336 but pins 326 offset from slot 336. This sleeve positioning leaves a small gap between sleeve 318 and the upper limit of its travel as established by stop shoulder 339. The movement, thereafter, of sleeve 318 to the open position is down, thus moving slot 336 further away from pins 326. Only when the sleeve is reclosed and moved up past its original run in position will pins 326 become aligned with, and able to drop into, slot 336. If there were only two sets of pins 324, 326, the sleeve could at this point be positioned against shoulder 339, but since there are further sets of pins 327, 328 in this embodiment, a gap will remain between shoulder 339 and sleeve 318 even when pins 326 are engaged in slot 336.

While an embodiment is shown for illustrative purposes, it is to be appreciated that various modifications can be made. For example, the shear pins could be installed on the sleeve, while the slots may be positioned on the housing wall. The slots may have other forms, such as being shorter, more cylindrical and/or closed. The first used set of shear pins 324 need not be biased by springs 366. Instead they may be rigidly installed in a securing position between the sleeve and wall after the sleeve is placed in the run in position.

Sleeve valve 310 may further include a releasable locking structure 342 for releasably holding the sleeve in the open and/or the closed positions. In the illustrated embodiment, releasable locking structure 342 includes a snap ring carried on the sleeve 318 and which is releasably landable in glands 344, 345 in the wall when the structure is moved to a position over the glands. Structure 342, while biased to expand out, it can be compressed radially inwardly to be removed from the gland by movement of the sleeve. Thus, while the holding force of structure 342 in a gland is sufficient to prevent the unintentional migration of the sleeve, the holding force can be readily overcome by smaller applied forces such as with a shifting tool.

For example, the ends of the releasably locking structure and/or the end walls of the glands can be formed, as by ramping, to allow the structure to more easily pull out of engagement when a suitable force is applied.

Sleeve valve 310 may include seals between the sleeve and the wall that seal fluid passage to port 314 when the sleeve is closed and/or seals in other locations that protect against infiltration of damaging debris.

The sliding sleeve valve of FIGS. 5*a* to 5*d* can be employed to permit a wellbore fluid treatment therethrough, then closed and reopened for three further fluid treatments. Both the opening and the reopening can be achieved by use of balls released to land in the seat of the sleeve. The operator can move the sleeve to close the ports using a shifting tool after each stimulation, but the ports can be reopened with a ball. The operator can, therefore, refracture the formation accessed through the sliding sleeve valve after the original production has started to decline. The process may be as follows:

FIGS. 5*a* and 6: Run in a completion string including a sliding sleeve valve 310. During run in, port 314 is closed by sleeve 318 and an initial holding mechanism of shear pins 324 holds the sleeve in this closed position. Shear pins 324 protrude into slot 336 on sleeve 318 and, therefore, secure sleeve 318 in place in the inner bore 316.

A second holding mechanism including a plurality of shear pins 326 is maintained in an inactive position. For example, pins 326, while biased radially inwardly against sleeve 318, are contained in an inwardly compressed condition and sleeve 318 can slide axially over them.

Further sleeve holding mechanisms including further sets of shear pins 327, 328 are also provided and maintained in inactive positions.

As noted above, the completion string may include more than one sliding sleeve valve, at least some of which may be operable by dropping balls. If the completion string includes a plurality of ball actuated sliding sleeve valves, the seats may be sized sequentially such that different sized balls open one or more different sleeves, with the smallest ball intended to open the lowest sleeve valve, which is that closest to bottom hole. The sleeve valve of FIG. 5*a* can be adapted to work with any particular diameter of ball by replacing the seat with one of an appropriate diameter.

After the completion string is positioned in the wellbore, it is set in the wellbore.

Figure 5B:
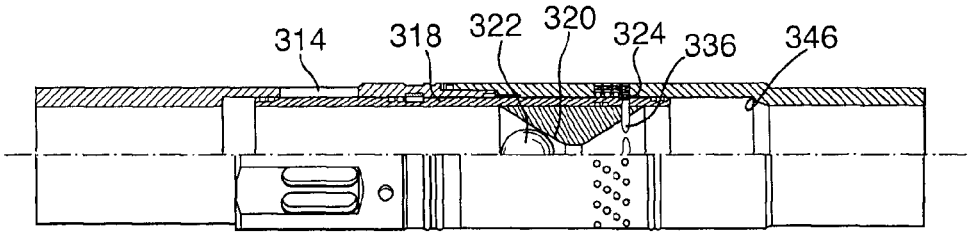

FIG. 5*b*: When it is desirable to access the wellbore through port 314, a ball 322 is launched to land in ball seat 320, creating an effective piston face across the sleeve and the string is pressured up to actuate the sleeve to move axially down to open the port.

Figure 5C:
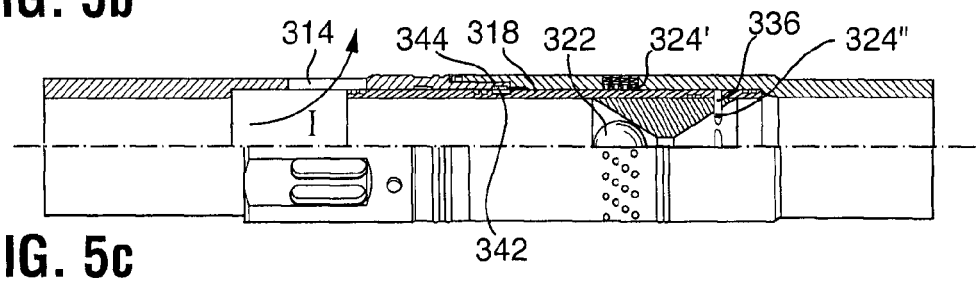

FIG. 5*c*: Movement of the sleeve is only permitted after the initial holding mechanism pins 324 are overcome by sufficient force applied hydraulically. Since the direction of movement of the sleeve is known, that being down away from surface, the location of the first set of pins 324 can be properly positioned as the lowest set. As such, as the sleeve is sheared from pins 324, the movement of sleeve will cause slot 336 to move away from the array of pins.

When ball 322 hits seat 320, pins 324 are sheared leaving one end 324*a*' in the wall and the sheared portions 324*a*" of the pins are carried with slots 336. Sheared portions 324*a*" of the pins may drop out of the open ends 336*a* of the slots.

Sleeve 318 moves until it becomes stopped against shoulder 346, at which point ring 342 drops into gland 344.

Fluid may then be injected, arrows I, through the inner diameter of the string to inner diameter 316 and out though port 314 to stimulate the formation at this stage. Fluid is diverted out through port 314, as the fluid is stopped from further movement through the string by ball 322 landed in seat 320.

Figure 5D:
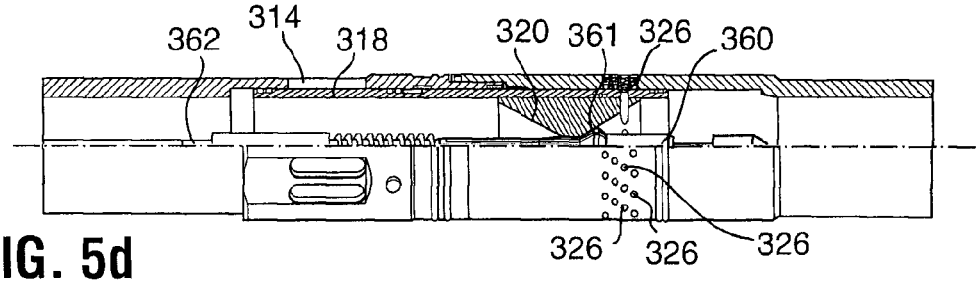

FIG. 5*d*: When desired, sleeve 318 may be closed to close the port. Closing is achieved with a shifting tool 360 run in on a string 362, such as coiled or jointed tubing, to move the sleeve. In one embodiment, the shifting tool is run in from surface, moved through the seat and pulled to surface. On the way out of the hole, the shifting tool catches on sleeve 318, such as against the underside of seat 320, and moves sleeve 318 up to a closed position. The sleeves may be closed to shut off production or for other reasons such as a desire to restimulate the formation. While the sleeve is held open by ring 342 landed in groove 344, sufficient force can be applied by tool 360 to urge the ring to be compressed inwardly, as by interaction of its ramped edge and to ride up out of the gland.

The closing process activates the second holding mechanism allowing the sliding sleeve valve 310 to function just as it did during the first stimulation: to be openable by landing a ball on seat 320. Movement of sleeve 318 up by shifting tool 360 moves the second set of shear pins 326 to an active position where they become engaged in slot 336 and create a lock between wall 314 and sleeve 318. In this embodiment, the shifting tool moves the sleeve up until the sleeve's movement is stopped by pins 326 popping out into slot. When pins engage in slot 336, the sleeve is stopped against further movement and shifting tool 360 pulls through seat 320. For example, the release on collet 361 of shifting tool 360 may be less than the holding force of shear pins 326. In one embodiment, for example, the force to overcome the holding force of pins may be 5 to 15 times the force required to collapse the shifting tool collet. In one embodiment, the force to collapse the shifting tool is 1000 to 3000 lbs while it takes 25,000 to 55,000 lbs to shear the ring of pins.

The second holding mechanism is engaged into the active position without removing the ball seat.

The pins in each set can be staggered from the next adjacent set as shown on the outer surface 312*c*, so that if a sheared portion of a pin from one set gets jammed in slot 336, a pin from the next set can still be biased into place in the slot. For example, the pins of set 326 are rotated a few degrees about the long axis x of sleeve valve 310 relative to the pins of set 324.

Thereafter, if it is desired to reopen ports 314, for example, to refracture the formation, a second ball is dropped to land on seat 320, move the sleeve 318 and open the port. The second ball is similar if not identical to the first ball 322. While sleeve 318 is held by the second holding mechanism 326, the holding force of that mechanism can be overcome when sufficient hydraulic force is applied through seat 320 to sleeve 318. In particular, the sleeve can be moved by shearing the pins 326. For example, when sufficient force is applied through sleeve 318 against pins 326, the pins fail and sleeve 318 can move down.

The operation of the further sets 327, 328 of shear pins is similar to set 326.

In another embodiment, for example, as shown in FIGS. 7 and 8, the initial holding mechanism is a set of shear pins 424 and the second holding mechanism is a set of shear pins 426, each set with similar holding properties. For example, the tool can include a plurality of shear pins in an array such that after a first set of shear pins 424, which act to hold the sleeve 418 in the run in position, is overcome (i.e. sheared), sleeve 418 can be reset to a reclosed position to be secured by a second set of shear pins 426 of the array. In addition to the two sets, one or more further sets 427 of shear pins can be provided in the array to allow the sleeve to be reset at least a further time.

With closer reference to FIG. 7, a sliding sleeve valve 410 has a housing with a tubular form including a tubular wall 412 with ends 412*a*, 412*b* formed for connection to adjacent tubulars to form a tubing string. Sliding sleeve valve 410 may, for example, be formed as a sub with ends 412*a*, 412*b* threaded for installation as by threaded connection to adjacent tubulars in a string.

Tubular wall 412 is shown in phantom in FIGS. 7*b* to 7*d* to facilitate illustration.

The sliding sleeve valve further includes at least one port 414 through the tubular wall providing access between an inner bore 416 of the valve and an outer surface 412*c* of the wall. A sleeve 418 is positioned in the inner bore 416 and is moveable to open and close port 414. In the closed position, the sleeve covers the port and in the open position, the sleeve is moved to expose the port to the inner bore. Sleeve 418 includes a ball seat on its inner diameter, which is exposed in the inner bore, providing a means for opening the sleeve by landing a ball or other plug form, on the seat and creating a pressure differential above and below the ball/seat to overcome an initial holding mechanism including a plurality 424 of shear pins holding the sleeve in the closed position. When the initial holding mechanism is overcome, the sleeve can be moved to the open position.

In addition to the initial holding mechanism, the tool includes a second holding mechanism including a plurality 426 of shear pins for the sleeve valve. The second holding mechanism is initially in an inactive position (FIG. 7*b*) but becomes activated (FIG. 7*d*) when the sleeve is reclosed. When activated, the second holding mechanism holds the sleeve closed, covering port 414, and readies the sleeve for reopening by landing a ball on the seat and creating a pressure differential above and below the ball/seat to overcome the second holding mechanism to move the sleeve from the closed position to the open position.

The holding mechanisms including the plurality shear pins 424 and 426 can each be overcome by applying axially directed force to the sleeve, as occurs when a ball lands in the seat and pressure is built up above the ball/seat.

The initial holding mechanism and the second holding mechanism can have shear stock with each set selected to respond to similar applications of force to be overcome. For example, both sets respond to axial application of force and an amount of force applied by a ball landing in seat. In one embodiment, the number and rating of shear pins can be substantially identical in the two sets 424, 426.

Each set of shear pins may include a plurality of spaced apart pins. The sets of pins are arranged so that the sleeve independently engages one set at a time. While the pins in each set are arranged in a ring around a circumference of the sleeve valve, either in the sleeve or in wall 412, as shown, it will be appreciated that various arrangements are possible. For example, the pins in set 424 together form a ring around wall 412 and are axially offset from a ring of pins forming set 426.

In the illustrated embodiment, there is a further set 427 that includes a plurality of pins arranged about the circumference and are each axially offset from set 426.

Each pin in each set is installed in a port and has an engagable portion that is protrudable out from the port to engage a pocket 436*a*-436*b* in the sleeve. The pins of set 424 are installed with their engagable portions each positioned in a pocket 436*a* on sleeve 418. The pins of sets 426 and 427 have their engageable portions biased outwardly from their ports, but forced into a retracted state until they are aligned over their pockets 436*b*, 436*c*, respectively. For example, with reference also to FIG. 8, each pin in sets 426 and 427, such as pin 426 in the set for second holding, is installed in a port 464 and is biased outwardly by a spring 466, such as a compression spring, from that port by the action of the spring pushing pin 426 away from an end wall 468*a* of the port. In this embodiment, end wall 468*a* is a surface of a threaded plug 468 installed in the port.

The pins are biased out from their ports such that they are pushed against the outer surface of sleeve 418 and protrude into any opening that becomes aligned below them. Thus, the sleeve can be held by the pins against axial movement by placement of an opening such as pockets 436*b*, 436*c* into alignment with the pins and into which the pins are biased to protrude.

The pockets 436*a*-436*c* in this embodiment are formed as slotted openings with one opening for each pin and the pockets extend fully through the thickness of the sleeve, but other forms are possible.

While the pins of the second and third holding mechanisms, such as pin 426 of FIG. 8*a*, are positioned between sleeve 418 and wall 412 before running into the wellbore, they only operate to hold the sleeve in position when the sleeve is indexed to align the pockets with the pins. The pins of set 426, such as pin 426 shown in FIG. 8*a*, only operate to hold the sleeve in position when the sleeve is reclosed after an initial opening operation (i.e. the one shearing pins 424). Thus, pins 426 don't become activated and set up to engage the sleeve until the sleeve is reclosed. The inactive positioning of pins, such as pin 426 of FIG. 8, is achieved by maintaining them out of alignment with their pockets 436*b* until the sleeve is reclosed.

For example, while pin 426 is biased to readily pop out into pocket 436*b*, pin 426 is maintained out of alignment with the pocket 436*b* until the sleeve is moved into the reclosed position. Before the sleeve is indexed to move the pocket under the pin, pin 426 is retracted and rides along the outer surface 418*a* of sleeve 418 (FIG. 8*a*). In the reclosed position, shown in FIG. 8*b*, pin 426 becomes aligned over its pocket 436*b* and is biased out into the pocket.

In this embodiment, an indexing arrangement is provided to guide sleeve between run-in, reclosed and further reclosed positions and, therefore, the engaged positions with first, second and third holding mechanisms. The indexing arrangement in this embodiment includes a J-slot 490 and a pin 492 for riding in the J-slot. The J-slot is formed to guide the indexing movements of the sleeve as it is driven axially. As the sleeve is moved axially, pin 492 is constrained to ride in J-slot 490 and the sleeve is urged to rotate slightly with each upward axial movement to index over a different set of pins. While J-slot 490 is shown on sleeve and pin 492 is shown carried on wall 412, these parts could be reversed if desired.

For example, during run in, as shown in FIGS. 7*b* and 8*a*, sleeve 418 is held by the pins 424 of the initial holding mechanism in a position with those pins protruding into pockets 436*a* but pins 426, 427 are offset from their pockets 436*b*, 436*c*, respectively. Concurrently, sleeve 418 is arranged with pin 492 in slot 490 in a first position A.

The movement, thereafter, of sleeve 418 to the open position is axially down, as a ball hits the seat. This moves the sleeve, as guided by the interaction of pin 492 and slot 490, to shear pins 424 and open ports 414. During this movement, pins 426, 427 ride along the OD 418*a* of the sleeve without becoming engaged: they remain retracted in their ports. When sleeve 418 is moved to open ports 414, the sleeve's movement is guided by the J-slot from position A to a second position B. When ports 414 are initially opened, the sleeve is positioned with pin 492 in second position B with respect to the J-slot, as shown in FIG. 7*c*.

When desired, sleeve 418 can be reclosed to reclose ports 414 and ready the sleeve valve for a second fluid stimulation operation. Only when the sleeve is reclosed and guided by J-slot 490 from position B to a third position C, will pins 426 become aligned over, and able to drop into, their pockets 436*b* (FIGS. 7*d* and 8*b*). The form of the J-slot ensures that axial movement of the sleeve urges the sleeve to rotate from position to position.

Thereafter, sleeve 418 may be again reopened by landing a ball against the seat in the sleeve. This moves the sleeve axially and slightly rotationally, as guided by the interaction of pin 492 and slot 490, to shear pins 426 and open ports 414. During this movement, pins 427 remain retracted in their ports and ride along the OD 418*a* of the sleeve without becoming engaged. When sleeve 418 is moved this second time to open ports 414, the sleeve's movement is guided by the J-slot from position C to a second open position D.

Again when desired, sleeve 418 can be reclosed to reclose ports 414 and ready the sleeve valve for a third fluid stimulation operation. Only when the sleeve is reclosed and guided by J-slot 490 from position D to a position E, will pins 427 become aligned over, and able to drop into, their pockets 436*c* (not shown). As noted, the form of the J-slot ensures that axial movement of the sleeve urges the sleeve to rotate from position to position engaging one set of shear pins at a time.

J-slot 490 can include a further pathway to a position F for reopening the sleeve and overcoming the holding force of pins 427. Thereafter, if the sleeve is reclosed, the sleeve is indexed back to position E. Of course, in this repositioning there will be no further engagement of pins, as all have been sheared, but some holding can be achieved by releasable locking structures such as snap rings if desired.

While an embodiment is shown for illustrative purposes, it is to be appreciated that various modifications can be made as will be apparent from the other embodiments disclosed hereinabove. For example, the shear pins could be installed on the sleeve, while the pockets may be positioned on the housing wall. The pockets may have other forms. The first used set of shear pins 424 could also be biased by springs 466, instead of being rigidly pre-installed.

The sliding sleeve valve of FIGS. 7*a* to 7*d* can be employed to permit a wellbore fluid treatment therethrough, then closed and reopened for two further fluid treatments. Both the opening and the reopenings can be achieved by use of balls released to land in the seat of the sleeve. The operator can move the sleeve to close the ports using a shifting tool after each stimulation, but the ports can be reopened with a ball. The operator can, therefore, refracture the formation accessed through the sliding sleeve valve after the original production has started to decline. The process is similar to that described above with respect to FIG. 5.

In the disclosed embodiments, pressures to overcome the initial holding and the second holding can be selected as desired. For example, shear pressures of up to 5,000 psi (~93,327 lbs force) are contemplated, but pressures of about 1000 to 4000 psi and more particularly 1500 to 3500 psi are most reasonable.

In one example embodiment, the sets of shear pins in each of the initial holding mechanism and the second holding mechanism each pin the tool to a nominal shear selected to be greater than 35,000 lbs, for example about 2150 psi (40,000 lbs), for example, to react to an overcoming pressure in the of range +/−10%: 1930 to 2360 psi. In this example, a snap ring is employed as a backup releasable lock when the initial holding and the second holding mechanisms are not operable (i.e. they have all been sheared out or to hold the sleeve open). The snap rings can be overcome by applied force of less than 1000 psi and, for example, about 6,000 to 8,000 lbs.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A sliding sleeve valve comprising:

a tubular body including a tubular wall including an outer surface and an inner surface defining an inner bore;

a fluid port extending through the tubular wall and providing fluidic communication between the outer surface and the inner bore;

a sliding sleeve in the inner bore slidably moveable between a port closed position and a port open position, the sliding sleeve including a ball seat on which a plug is landed to move the sleeve from the port closed position to the port open position;

an initial sleeve holding mechanism for holding the sliding sleeve in the port closed position, the initial sleeve holding mechanism selected to be overcome by landing a plug on the ball seat to move the sliding sleeve; and a second sleeve holding mechanism for holding the sliding sleeve in the port closed position after the sliding sleeve is reclosed from the port open position to the port closed position, the second sleeve holding mechanism selected to be overcome by landing a plug on the ball seat to move the sliding sleeve and the second sleeve holding mechanism including shear stock that are sheared when overcome.

2. The sliding sleeve valve of claim 1 wherein only a force greater than 35,000 lbs is sufficient to overcome the second sleeve holding mechanism.

3. The sliding sleeve valve of claim 1 wherein the initial holding mechanism includes shear stock that are sheared when overcome.

4. The sliding sleeve valve of claim 3 wherein the second holding mechanism includes a locking mechanism including the shear stock and the locking mechanism is maintained in an initial retracted position and biased to move into an active position only when the sliding sleeve is reclosed.

5. The sliding sleeve valve of claim 3 wherein the second holding mechanism includes the shear stock maintained in an initial retracted position and biased to move into an active position only when the sliding sleeve is reclosed.

6. The sliding sleeve valve of claim 1 wherein the initial holding mechanism includes collet dogs that are disengaged from a gland when the initial holding mechanism is overcome.

7. The sliding sleeve valve of claim 1 wherein the initial holding mechanism includes ratchet teeth that are disengaged from corresponding ratchet teeth when the initial holding mechanism is overcome.

8. The sliding sleeve valve of claim 1 wherein the initial holding mechanism and the second holding mechanism are the separate mechanisms.

9. The sliding sleeve valve of claim 1 wherein the second holding mechanism is maintained in an inactive condition while the initial holding mechanism is active.

10. A method for refracturing a formation, the formation having been originally fractured by landing a ball on a sleeve to move the sleeve to expose a port to fracturing fluid flow therethrough and injecting fracturing fluid through the port, the method comprising:

closing the sleeve over the port;

setting a holding mechanism to hold the sleeve in place;

landing a ball on the sleeve to overcome the holding mechanism and to move the sleeve to expose the port to fracturing fluid flow therethrough, wherein overcoming the holding mechanism includes shearing shear stock to permit movement of the sleeve; and injecting fracturing fluid through the port to refracture the formation.

11. The method of claim 10 wherein closing the sleeve includes moving the sleeve with a shifting tool engaged against a ball seat in the sleeve.

12. The method of claim 10 wherein setting occurs automatically during closing.

13. The method of claim 10 wherein setting the holding mechanism includes biasing the holding mechanism into an active position during closing.

14. The method of claim 10 further comprising reclosing the sleeve over the port; setting another holding mechanism to hold the sleeve in place; landing a ball on the sleeve to overcome the another holding mechanism and to move the sleeve to expose the port to fracturing fluid flow therethrough; and injecting fracturing fluid through the port to refracture the formation.

15. The method of claim 10 further comprising removing a ball seat from the sleeve.

16. The method of claim 10 further comprising positioning the port adjacent an open hole region of a wellbore accessing the formation.

17. A method for fluid treatment of a formation accessed through a wellbore, the method comprising:

running into the wellbore with a fluid treatment string including a sliding sleeve valve with a sleeve closing a port;

landing a ball on the sleeve to overcome an initial holding mechanism for the sleeve and to move the sleeve to expose the port to a fluid flow therethrough;

injecting fluid through the port to fluid treat the formation;

closing the sleeve over the port;

setting a second holding mechanism to hold the sleeve in place;

landing a second ball on the sleeve to overcome the second holding mechanism and to move the sleeve to expose the port to a fluid flow therethrough, wherein overcoming the second holding mechanism includes shearing shear stock to permit movement of the sleeve; and injecting fluid through the port to fluid treat the formation.

18. The method of claim 17 wherein closing the sleeve includes moving the sleeve with a shifting tool engaged against a ball seat in the sleeve.

19. The method of claim 17 wherein setting occurs automatically during closing.

20. The method of claim 17 wherein setting the second holding mechanism includes biasing the second holding mechanism into an active position during closing.

21. The method of claim 17 further comprising reclosing the sleeve over the port; setting a third holding mechanism to hold the sleeve in place; landing a ball on the sleeve to overcome the third holding mechanism and to move the sleeve to expose the port to fracturing fluid flow therethrough; and injecting fracturing fluid through the port to refracture the formation.

22. The method of claim 17 further comprising removing a ball seat from the sleeve.

23. The method of claim 17 further comprising positioning the port adjacent an open hole region of a wellbore accessing the formation.

24. A sliding sleeve valve comprising:

a tubular body including a tubular wall including an outer surface and an inner surface defining an inner bore;

a fluid port extending through the tubular wall and providing fluidic communication between the outer surface and the inner bore;

a sliding sleeve in the inner bore slidably moveable between a port closed position and a port open position, the sliding sleeve including a ball seat on which a plug is landed to move the sleeve from the port closed position to the port open position;

an initial sleeve holding mechanism for holding the sliding sleeve in the port closed position, the initial sleeve holding mechanism selected to be overcome by landing a plug on the ball seat to move the sliding sleeve; and a second sleeve holding mechanism for holding the sliding sleeve in the port closed position after the sliding sleeve is reclosed from the port open position to the port closed position, the second sleeve holding mechanism selected to be overcome by landing a plug on the ball seat to move the sliding sleeve and the second sleeve holding mechanism including collet dogs that are disengaged from a gland when the second holding mechanism is overcome.

25. The sliding sleeve valve of claim 24 wherein only a force greater than 35,000 lbs is sufficient to overcome the second sleeve holding mechanism.

26. The sliding sleeve valve of claim 24 wherein the initial holding mechanism includes shear stock that are sheared when overcome.

27. The sliding sleeve valve of claim 24 wherein the initial holding mechanism includes collet dogs that are disengaged from a gland when the initial holding mechanism is overcome.

28. The sliding sleeve valve of claim 24 wherein the initial holding mechanism includes ratchet teeth that are disengaged from corresponding ratchet teeth when the initial holding mechanism is overcome.

29. The sliding sleeve valve of claim 24 wherein the initial holding mechanism and the second holding mechanism are separate mechanisms.

30. The sliding sleeve valve of claim 24 wherein the second holding mechanism is maintained in an inactive condition while the initial holding mechanism is active.

31. A sliding sleeve valve comprising:

a tubular body including a tubular wall including an outer surface and an inner surface defining an inner bore;

a fluid port extending through the tubular wall and providing fluidic communication between the outer surface and the inner bore;

a sliding sleeve in the inner bore slidably moveable between a port closed position and a port open position, the sliding sleeve including a ball seat on which a plug is landed to move the sleeve from the port closed position to the port open position;

an initial sleeve holding mechanism for holding the sliding sleeve in the port closed position, the initial sleeve holding mechanism selected to be overcome by landing a plug on the ball seat to move the sliding sleeve; and a second sleeve holding mechanism for holding the sliding sleeve in the port closed position after the sliding sleeve is reclosed from the port open position to the port closed position, the second sleeve holding mechanism selected to be overcome by landing a plug on the ball seat to move the sliding sleeve and the second sleeve holding mechanism including ratchet teeth that are disengaged from corresponding ratchet teeth when the second holding mechanism is overcome.

32. The sliding sleeve valve of claim 31 wherein only a force greater than 35,000 lbs is sufficient to overcome the second sleeve holding mechanism.

33. The sliding sleeve valve of claim 31 wherein the initial holding mechanism includes shear stock that are sheared when overcome.

34. The sliding sleeve valve of claim 31 wherein the initial holding mechanism includes collet dogs that are disengaged from a gland when the initial holding mechanism is overcome.

35. The sliding sleeve valve of claim 31 wherein the initial holding mechanism includes ratchet teeth that are disengaged from corresponding ratchet teeth when the initial holding mechanism is overcome.

36. The sliding sleeve valve of claim 31 wherein the initial holding mechanism and the second holding mechanism are separate mechanisms.

37. The sliding sleeve valve of claim 31 wherein the second holding mechanism is maintained in an inactive condition while the initial holding mechanism is active.

38. A method for refracturing a formation, the formation having been originally fractured by landing a ball on a sleeve to move the sleeve to expose a port to fracturing fluid flow therethrough and injecting fracturing fluid through the port, the method comprising:

closing the sleeve over the port, including moving the sleeve with a shifting tool engaged against a ball seat in the sleeve;

setting a holding mechanism to hold the sleeve in place;

landing a ball on the sleeve to overcome the holding mechanism and to move the sleeve to expose the port to fracturing fluid flow therethrough; and injecting fracturing fluid through the port to refracture the formation.

39. A method for refracturing a formation, the formation having been originally fractured by landing a ball on a sleeve to move the sleeve to expose a port to fracturing fluid flow therethrough and injecting fracturing fluid through the port, the method comprising:

closing the sleeve over the port;

setting a holding mechanism to hold the sleeve in place;

landing a ball on the sleeve to overcome the holding mechanism and to move the sleeve to expose the port to fracturing fluid flow therethrough, wherein overcoming the holding mechanism includes disengaging ratchet teeth from corresponding ratchet teeth to permit movement of the sleeve; and injecting fracturing fluid through the port to refracture the formation.

40. A method for refracturing a formation, the formation having been originally fractured by landing a ball on a sleeve to move the sleeve to expose a port to fracturing fluid flow therethrough and injecting fracturing fluid through the port, the method comprising:

closing the sleeve over the port;

setting a holding mechanism to hold the sleeve in place;

landing a ball on the sleeve to overcome the holding mechanism and to move the sleeve to expose the port to fracturing fluid flow therethrough, wherein overcoming the holding mechanism includes disengaging collet dogs from a gland to permit movement of the sleeve; and injecting fracturing fluid through the port to refracture the formation.

41. A method for refracturing a formation, the formation having been originally fractured by landing a ball on a sleeve to move the sleeve to expose a port to fracturing fluid flow therethrough and injecting fracturing fluid through the port, the method comprising:

closing the sleeve over the port;

setting a holding mechanism to hold the sleeve in place;

landing a ball on the sleeve to overcome the holding mechanism and to move the sleeve to expose the port to fracturing fluid flow therethrough;

injecting fracturing fluid through the port to refracture the formation;

reclosing the sleeve over the port;

setting another holding mechanism to hold the sleeve in place;

landing a ball on the sleeve to overcome the another holding mechanism and to move the sleeve to expose the port to fracturing fluid flow therethrough; and injecting fracturing fluid through the port to refracture the formation.

42. A method for refracturing a formation, the formation having been originally fractured by landing a ball on a sleeve to move the sleeve to expose a port to fracturing fluid flow therethrough and injecting fracturing fluid through the port, the method comprising:

closing the sleeve over the port;

setting a holding mechanism to hold the sleeve in place;

landing a ball on the sleeve to overcome the holding mechanism and to move the sleeve to expose the port to fracturing fluid flow therethrough;

injecting fracturing fluid through the port to refracture the formation; and removing a ball seat from the sleeve.

43. A method for fluid treatment of a formation accessed through a wellbore, the method comprising:

running into the wellbore with a fluid treatment string including a sliding sleeve valve with a sleeve closing a port;

landing a ball on the sleeve to overcome an initial holding mechanism for the sleeve and to move the sleeve to expose the port to a fluid flow therethrough;

injecting fluid through the port to fluid treat the formation;

closing the sleeve over the port by moving the sleeve with a shifting tool engaged against a ball seat in the sleeve;

setting a second holding mechanism to hold the sleeve in place;

landing a second ball on the sleeve to overcome the second holding mechanism and to move the sleeve to expose the port to a fluid flow therethrough; and injecting fluid through the port to fluid treat the formation.

44. A method for fluid treatment of a formation accessed through a wellbore, the method comprising:

running into the wellbore with a fluid treatment string including a sliding sleeve valve with a sleeve closing a port;

landing a ball on the sleeve to overcome an initial holding mechanism for the sleeve and to move the sleeve to expose the port to a fluid flow therethrough;

injecting fluid through the port to fluid treat the formation;

closing the sleeve over the port;

setting a second holding mechanism to hold the sleeve in place;

landing a second ball on the sleeve to overcome the second holding mechanism and to move the sleeve to expose the port to a fluid flow therethrough, wherein overcoming the second holding mechanism includes disengaging ratchet teeth from corresponding ratchet teeth to permit movement of the sleeve; and injecting fluid through the port to fluid treat the formation.

45. A method for fluid treatment of a formation accessed through a wellbore, the method comprising:

running into the wellbore with a fluid treatment string including a sliding sleeve valve with a sleeve closing a port;

landing a ball on the sleeve to overcome an initial holding mechanism for the sleeve and to move the sleeve to expose the port to a fluid flow therethrough;

injecting fluid through the port to fluid treat the formation;

closing the sleeve over the port;

setting a second holding mechanism to hold the sleeve in place;

landing a second ball on the sleeve to overcome the second holding mechanism and to move the sleeve to expose the port to a fluid flow therethrough, wherein overcoming the second holding mechanism includes disengaging collet dogs from a gland to permit movement of the sleeve; and injecting fluid through the port to fluid treat the formation.

46. A method for fluid treatment of a formation accessed through a wellbore, the method comprising:

running into the wellbore with a fluid treatment string including a sliding sleeve valve with a sleeve closing a port;

landing a ball on the sleeve to overcome an initial holding mechanism for the sleeve and to move the sleeve to expose the port to a fluid flow therethrough;

injecting fluid through the port to fluid treat the formation;

closing the sleeve over the port;

setting a second holding mechanism to hold the sleeve in place;

landing a second ball on the sleeve to overcome the second holding mechanism and to move the sleeve to expose the port to a fluid flow therethrough;

injecting fluid through the port to fluid treat the formation;

reclosing the sleeve over the port;

setting a third holding mechanism to hold the sleeve in place;

landing a ball on the sleeve to overcome the third holding mechanism and to move the sleeve to expose the port to fracturing fluid flow therethrough; and injecting fracturing fluid through the port to refracture the formation.

* * * * *